US008131163B2

(12) United States Patent
Matsui et al.

(10) Patent No.: US 8,131,163 B2
(45) Date of Patent: Mar. 6, 2012

(54) IMAGE FORMING APPARATUS FOR PERFORMING AN MICR PRINTING OPERATION

(75) Inventors: Hideaki Matsui, Kanagawa (JP); Yutaka Matsumoto, Saitama (JP); Nobuyuki Iwata, Kanagawa (JP); Tsuyoshi Sakuma, Kanagawa (JP); Hajime Kubota, Tokyo (JP); Daisuke Masui, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 417 days.

(21) Appl. No.: 12/382,375

(22) Filed: Mar. 16, 2009

(65) Prior Publication Data

US 2009/0232520 A1 Sep. 17, 2009

(30) Foreign Application Priority Data

Mar. 14, 2008 (JP) ..... 2008-065251
May 8, 2008 (JP) ..... 2008-121785

(51) Int. Cl.
*G03G 15/00* (2006.01)
*G03G 15/06* (2006.01)
*G03G 21/00* (2006.01)
*G03G 21/18* (2006.01)

(52) U.S. Cl. ..... 399/12; 358/1.15; 399/80; 399/82

(58) Field of Classification Search ..... 399/3, 12, 399/24, 80, 82; 358/1.15
See application file for complete search history.

(56) References Cited

U.S. PATENT DOCUMENTS

| | | | | |
|---|---|---|---|---|
| 5,291,243 | A * | 3/1994 | Heckman et al. | 399/3 |
| 6,909,856 | B2 * | 6/2005 | Crichton | 399/12 |
| 6,965,744 | B1 * | 11/2005 | Housel | 399/82 |
| 7,289,133 | B1 * | 10/2007 | Friedrich et al. | 347/112 |
| 7,526,215 | B2 * | 4/2009 | Moodie et al. | 399/24 |
| 7,839,521 | B2 * | 11/2010 | Bard et al. | 358/1.15 |
| 2005/0095016 | A1 * | 5/2005 | Simpson et al. | 399/12 |
| 2008/0198404 | A1 | 8/2008 | Saito et al. | |
| 2008/0297838 | A1 | 12/2008 | Matsui et al. | |

FOREIGN PATENT DOCUMENTS

| | | |
|---|---|---|
| JP | 10-151832 | 6/1998 |
| JP | 10-161508 | 6/1998 |

* cited by examiner

*Primary Examiner* — David Gray
*Assistant Examiner* — Fred L Braun
(74) *Attorney, Agent, or Firm* — Harness, Dickey & Pierce, P.L.C.

(57) ABSTRACT

An image forming apparatus including an image forming unit configured to form an image onto an image forming medium based on received print data by using a cartridge removably provided, a cartridge determination unit configured to determine whether an MICR cartridge is inserted as the cartridge, a determination unit configured to compare a password input by an password input unit and a password registered in a password storage unit and determine whether an image forming process of the received print data is allowed to be performed, and a control unit configured to temporarily stop processing the print data, cause the notification unit to send the notification to input the password, and perform an MICR image forming control process that causes the image forming unit to resume the processing of the print data.

16 Claims, 21 Drawing Sheets

IMAGE FORMING APPARATUS FOR PERFORMING AN MICR PRINTING OPERATION

CROSS-REFERENCE TO RELATED APPLICATIONS

The present application claims priority under 35 U.S.C §119 to Japanese Patent Application Publication Nos. 2008-065251, filed Mar. 14, 2008, and 2008-121785, filed May 8, 2008, the entire contents of which are hereby incorporated herein by reference.

BACKGROUND OF THE INVENTION

1. Field of the Invention

The present invention generally relates to an image forming apparatus, an image forming control method, an image forming control program and a recording medium. More particularly, the present invention relates to an image forming apparatus, an image forming control method, an image forming control program, and a recording medium having a printing function to perform at least MICR (Magnetic Ink Character Recognition) printing capable of securing the MICR printing scheme and performing normal printing using an MICR cartridge without performing an authentication process.

2. Description of the Related Art

In a printing device and a multi-functional peripheral, images of valuable paper (document) such as a check and a bill have been also printed. In printing an image of such an important document, magnetic toner has been conventionally used and a password input has been also required so that, when the password authentication is successively completed, the print data are so-called MICR printed. Further, in this MICR printing, a font having a particular shape called an MICR font has been used.

Conventionally, an image forming apparatus capable of printing the MICR printing has been configured to print normal printing as well by having a configuration in which a process cartridge for MICR printing and a process cartridge for normal printing can be exchanged with each other (see Japanese Patent Application Publication No. H 10-161508). This configuration has been generally provided because an image forming apparatus capable of only MICR printing lacks versatility. Further, in this image forming apparatus, the result of the determination whether the process cartridge for MICR printing or the process cartridge for normal printing is inserted is stored in a non-volatile memory (such as NV-RAM (Nonvolatile Random Access Memory), so that information whether the process cartridge for MICR printing or the process cartridge for normal printing is inserted is displayed on a display of a user interface section of the apparatus. Further, some image forming apparatuses capable of printing MICR printing have a function to prevent a copy mode operation or a facsimile mode operation while a cartridge for MICR printing is in place as a process cartridge to be operated in an image forming apparatus (see Japanese Patent Application Publication NO. H10-151832).

On the other hand, recently, many apparatuses have been designed to be connected to a network. As a result, an image forming apparatus capable of printing MICR printing is also required to be connected to a network so that plural host systems such as computers connected to the image forming apparatus via the network can print out print data. In such an environment, the function of informing whether the process cartridge for MICR printing or the process cartridge for normal printing is inserted is displayed on a display of a user interface section of the apparatus. However such a user interface may not prevent the problem of a user picking up and taking away the MICR printing result (i.e. such as checks and bills) that the other user has printed. Therefore, there is demand for a solution to prevent the problem from occurring by improving the security of the secret document and the important documents. Further, while a process cartridge for MICR printing is inserted, a host system may request MICR printing requiring password authentication (hereinafter referred to as "authentication-requiring MICR printing") or normal printing using the process cartridge for MICR printing without requiring password authentication (hereinafter referred to as normal "MICR printing").

However, in the related-art technology described above, it becomes possible to switch between the MICR printing and the normal printing by exchanging the process cartridge for MICR printing and the process cartridge for normal printing. Further, as described above, when the process cartridge for the MICR printing is inserted, by preventing the copy-mode and facsimile-mode operations, a forgery of the important document is prevented. However, while such a process cartridge for the MICR printing is inserted, if an event to print authentication-requiring MICR printing that requires password authentication process occurs, a print request including the normal MICR printing that does not require password authentication occurring after the event to print authentication-requiring MICR printing is required to wait to start printing until the password authentication process is successfully completed and then the authentication-requiring MICR printing is completed. Therefore, if a user who has sent the print request of the authentication-requiring MICR printing takes time to complete the password authentication process, any processes occurring after the print request are not performed until after the authentication-requiring MICR printing is completed.

As a result, in a case where an event occurs to print normal MICR printing that is required to be performed urgently, if there is an authentication-requiring MICR printing job accumulated in advance, the process may be stopped, which is thought to be amended to improve the usability of the image forming apparatus.

Similar problems may occur in a case where an event occurs to print normal printing using the process cartridge for normal printing without using the process cartridge for MICR printing after the authentication-requiring MICR printing is started. Namely, as long as the authentication-requiring MICR printing is not completed, the process cartridge for MICR printing cannot be exchanged with the process cartridge for normal printing and therefore the normal printing is required to wait.

SUMMARY OF THE INVENTION

Further, as described above, in response to the demand for preventing the problem that someone picks up and takes away the print result of the MICR printing, there is also provided an image forming apparatus, an image forming control method, an image forming control program, and a recording medium that may solve the problem by improving the security (protectability) of the important documents.

To that end, in a printing apparatus according to an embodiment of the present invention, when an image is printed on the sheet based on the received print data by using a removably inserted process cartridge, it is determined whether the MICR-printing process cartridge is inserted as the process cartridge. When it is determined that the MICR-printing process cartridge is inserted as the process cartridge, the process for printing the received print data is temporarily stopped and the password input menu is displayed as notification output. When the password is input in response to the notification output, the password registered in advance in a password storage is compared with the input password to determine whether the print data are allowed to be printed. When it is determined that the print data are allowed to be printed, the temporality stopped MICR image forming control process for printing the print data is performed (restarted).

Further, whether the print data are the MICR print data may be determined based on whether MICR identification data are added to the print data. When it is determined that the print data are the MICR print data, the MICR image forming control process is performed and the MICR identification data are removed from the print data.

Further, only when the function of the MICR image forming control process is turned ON, the MICR image forming control process may be performed.

Further, the password in the password storage unit may be registered and the password registered in the password storage unit may be deleted and changed in response to a request from a predetermined external apparatus.

Further, based on the notification output, a predetermined lamp may be turned ON or blink as well as an input menu for the password being displayed.

To overcome at least one of the above problems, according to an embodiment of the present invention, the authentication-requiring MICR print data that require performing the password authentication process and other print data are accumulated in an accumulation unit and by appropriately changing the order of printing those data, it may become possible to provide an image forming apparatus, an image forming control method, an image forming control program, and a recording medium having excellent usability.

To that end, according to an embodiment of the present invention, in a case where data to be printed at least some of which are MICR print data are received and an image of the data to be printed is formed, it is determined whether received data to be printed are authentication-requiring MICR print data that require performing a password authentication process or normal MICR print data that do not require performing the password authentication process. When it is determined that the received data to be printed are the authentication-requiring MICR print data, the authentication-requiring MICR print data are temporarily accumulated into the accumulation unit. Then, the accumulated authentication-requiring MICR print data are read from the accumulation unit at a predetermined timing, and an image of the authentication-requiring MICR print data is formed.

Further, a password may be requested to be input at a predetermined timing. Then, when an image forming process is allowed to be performed based on the determination there is consistency between the input password and a password registered in a password storage unit, the authentication-requiring MICR print data may be read from the accumulation unit so that an image of the authentication-requiring MICR print data is formed.

Further, when the normal MICR print data are received while the password input is requested, the password input request may be temporarily stopped and an image of the normal MICR print data may be formed with priority.

According to an embodiment of the present invention, as described above, when data to be printed at least some of which are MICR print data are received and an image of the data to be printed is formed, it is determined whether received data are authentication-requiring MICR print data that require performing a password authentication process or normal MICR print data that do not require performing the password authentication process. Further, when it is determined that the received data are the authentication-requiring MICR print data, the authentication-requiring MICR print data are temporarily accumulated into the accumulation unit. Then, the accumulated authentication-requiring MICR print data are read from the accumulation unit at a predetermined timing, and an image of the authentication-requiring MICR print data is formed. Therefore, it may become possible to improve the degree of freedom in handling the authentication-requiring MICR print data, thereby enabling improving the usability of the image forming apparatus.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

In the following, preferred embodiments of the present invention are described with reference to the accompanying drawings. The embodiments described below are preferred embodiments of the present invention. Therefore, the embodiments described below may be limited to the technically preferable embodiments. However, the scope of the present invention should not be unreasonably limited to the embodiments described below. Further, each element described in the embodiments below may not be always necessary to constitute the present invention.

First Embodiment

Figure 1:
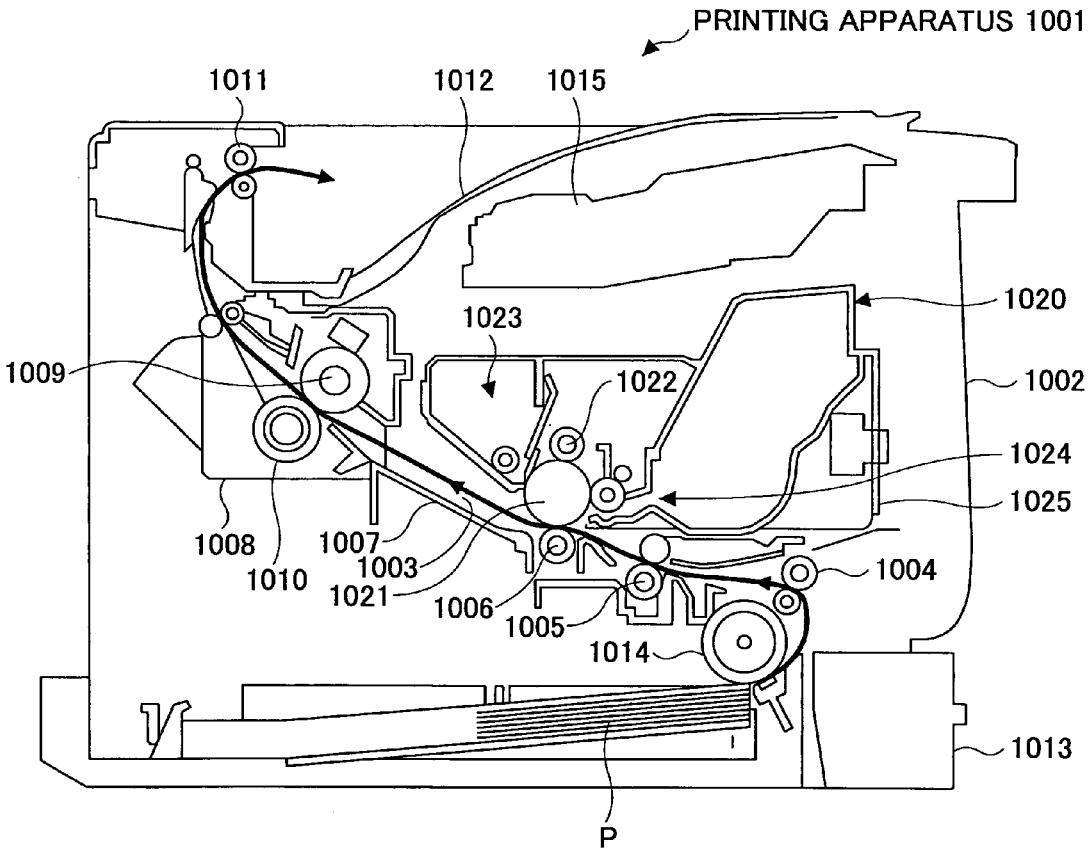
FIG. 1 is a schematic cross-sectional view showing a printing apparatus according to an embodiment of the present invention.

Before a feature and an operation of this embodiment are described, a configuration of an image forming apparatus according to this embodiment of the present invention is described. FIGS. 1 through 5 are drawings showing an image forming apparatus, an image forming control method, an image forming control program, and a recording medium according to a first embodiment of the present invention. FIG. 1 is a schematic cross-sectional view showing a printing apparatus 1001 according to the embodiment of the present invention.

As shown in FIG. 1, the printing apparatus (image forming apparatus) 1001 has a main body chassis 1002 in which a sheet feeding path 1003 is formed. Along the sheet feeding path 1003, there are provided a feeding roller 1004, a resist roller 1005, a transfer roller 1006, a guide plate 1007 and the like. Further, in the main body chassis 1002, a fixing section 1008 is further provided on the downstream side of the sheet feeding path 1003. In the fixing section 1008, a fixing roller 1009 and a pressing roller 1010 are provided. The fixing roller 1009 is heated at a fixing temperature and rotary driven. The pressing roller 1010 is in contact with the fixing roller 1009 so as to integrally rotate with the fixing roller 1009. In the printing apparatus 1001, a discharge roller 1011 is disposed on the downstream side of the fixing section 1008 in the main body chassis 1002, and a discharge section 1012 is formed on the upper side in the main body chassis 1002.

Further, in the printing apparatus 1001, a sheet supply cassette 1013 is slidably provided in the lower side in the main body chassis 1002. In the sheet supply cassette 1013, a plurality of sheets P are contained. Above the sheet supply cassette 1013, a pick up roller 1014 is provided. The pick up roller 1014 picks up and feeds the sheets P contained in the sheet supply cassette 1013 one by one to the feeding roller 1004.

The printing apparatus 1001 can perform the MICR printing described in detail below. In typical MICR printing, as described above, important documents such as checks or bills are printed, therefore, dedicated sheets P suited to the purpose of the MICR printing are generally used.

Further, in the printing apparatus 1001, an optical writing unit 1015 is provided in the main body chassis 1002. The optical writing unit 1015 includes a polygon motor, a polygon mirror, an Fθ lens, a laser diode as a light source, a mirror and the like so that an optical writing beam modulated in accordance with the data to be printed emits from the laser diode.

Further, above the sheet feeding path 1003 in the printing apparatus 1001, a process cartridge 1020 is removably provided (inserted). In the process cartridge 1020 forming a structure above the sheet feeding path 1003, a photosensitive body 1021, a charging roller 1022, a cleaning/waste toner collecting section 1023, a developing/toner storing section 1024 and the like are provided and integrally constituting the process cartridge 1020. The process cartridge 1020 is removably provided and housed in the main body chassis 1002 of the laser printer 1001 in a manner so that the photosensitive body 1021 of the process cartridge 1020 faces and is in contact with the transfer roller 1006. In between the photosensitive body 1021 and the transfer roller 1006, a sheet P is fed that has been separated one by one from the sheet feeding cassette by the pick up roller 1014, fed to the resist roller 1005 by the feeding roller 1004, and fed by the resist roller 1005 after the timing is adjusted by resist roller 1005.

The photosensitive body 1021 of the process cartridge 1020 is driven by a driving mechanism (not shown) to be rotated in the clockwise direction of FIG. 1. While being rotated, the surface of the photosensitive body 1021 is uniformly charged by the charging roller 1022. By irradiating the laser light emitted from the optical writing unit 1015 onto the surface of the photosensitive body 1021, a latent image is formed on the surface of the photosensitive body 1021. When the latent image passes the position of the developing/toner storing section 1024, toner (image forming material) is supplied from the developing/toner storing section 1024 onto the surface of the photosensitive body 1021 so that the latent image is visualized by forming a toner image on the surface of the photosensitive body 1021. After the photosensitive body 1021 further rotates so that the toner image on the photosensitive body 1021 faces the transfer roller 1006, the toner image is transferred onto the sheet fed in between the transfer roller 1006 and the photosensitive body 1021. The printing apparatus 1001 feeds the sheet P on which the toner image is transferred to the fixing section 1008. The fixing section 1008 presses and heats the fed sheet P by the fixing roller 1009 heated at a fixing temperature and a pressing roller 1010 to fix the toner image onto the sheet P to the sheet P. The printing apparatus 1001 feeds the sheet P on which the fixing of the toner image is completed to the upper side of the discharge section 1012 by using the discharge roller 1011. After the transfer is finished, the photosensitive body 1021 of the process cartridge 1020 further rotates so that the residual toner on the surface of the photosensitive body 1021 is removed by the cleaning/waste toner collecting section 1023 so that the photosensitive body 1021 can be used again for the image forming process described above again.

The transfer of the toner image on the photosensitive body 1021 onto the sheet P is enabled by a transfer current (transfer power) supplied to the transfer roller 1006, and the larger the transfer current becomes, the better the transfer performance becomes.

Further, in the printing apparatus 1001, as the process cartridge 1020, each of a normal-printing process cartridge used for the normal printing and an MICR-printing process cartridge used for the MICR printing can be exchangeably provided (inserted).

Further, the printing apparatus 1001 includes a cartridge determination section 1105 (see FIG. 3) determining whether the process cartridge 1020 provided in the printing apparatus 1001 is the normal-printing process cartridge or the MICR-printing process cartridge by acquiring information by wire (by, for example, connector connection) or wirelessly (by wireless communication such as RFID (Radio Frequency-Identification)). Particularly, the cartridge determination section 1105 may determine that the MICR-printing process cartridge is provided (inserted) by acquiring information about the MICR-printing process cartridge from, for example, a memory (such as a memory tag and an IC chip) incorporated in the MICR-printing process cartridge. Namely, at least, the MICR-printing process cartridge incorporates the memory including cartridge information (identification information) indicating that the cartridge is for MICR printing. Further, as the memory, non-volatile memory that can preserve the stored data without power being supplied may be used.

Figure 2:
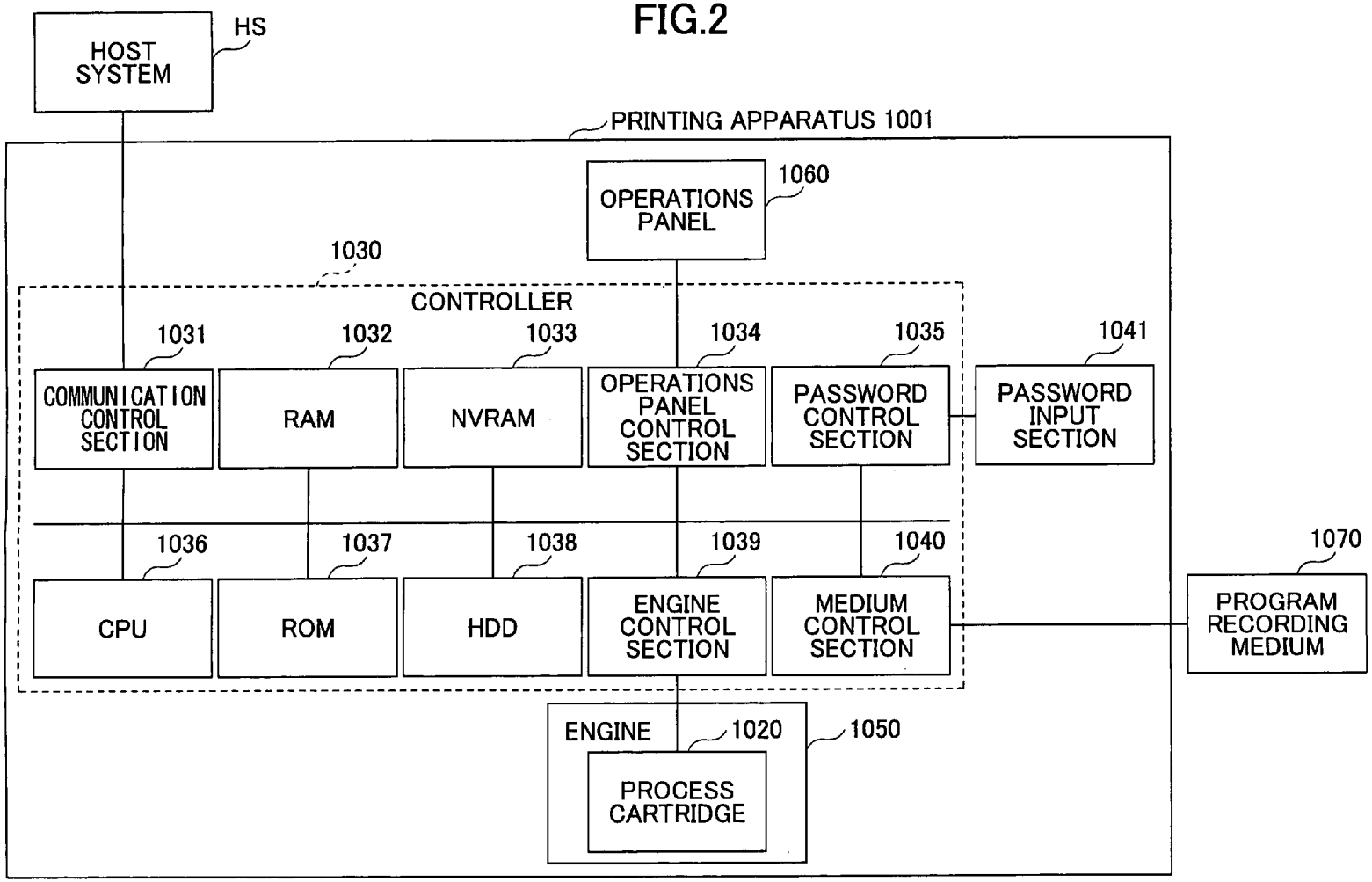
FIG. 2 is a schematic block diagram showing a main part of a hardware configuration of the printing apparatus of FIG. 1.

Further, FIG. 2 is a schematic block diagram showing a main part of a hardware configuration of the printing apparatus 1001. As shown in FIG. 2, the printing apparatus 1001 includes a controller 1030, an engine 1050, an operations panel 1060 and the like.

The engine (printing means) 1050 is a generic term covering any element constituting an image forming system such as the sheet feeding system described above, the photosensitive body 1021, the charging roller 1022, the cleaning/waste toner collecting section 1023, the developing/toner storing section 1024, a cartridge casing 1025, and the process cartridge 1020, and an discharge system such as discharge section 1012. Further, the process cartridge 1020 is removably inserted in the engine 1050.

The operations panel (notification means, ON/OFF setting means) 1060 includes various operation keys necessary for operating the printing apparatus 1001 and a display (such as a liquid crystal display), the operation keys including a start key, a stop key, ten keys, an image-quality setting key, an MICR lock mode ON/OFF key and the like. The display displays dedicated contents input via the operation keys, various information to be notified to a user from the printing apparatus 1001, and especially, various information necessary for an image forming control process to perform an image forming control method in the MICR printing. In that sense, the operations panel 1060 serves as notification means and ON/OFF setting means.

The controller 1030 includes a communication control section 1031, RAM (Random Access Memory) 1032, NVRAM (Non-Volatile Random Access Memory) 1033, a operations panel control section 1034, a password control section 1035, a CPU (Central Processing Unit) 1036, ROM (Read Only Memory) 1037, a HDD (Hard Disk Drive) 1038, an engine control section 1039, a medium control section 1040 and the like. The password control section 1035 is connected to a password input section 1041, and the medium control section 1040 is connected to a program recording medium 1070.

The communication control section 1031 is connected to the host system HS which may be a computer or the like via communication line such as a LAN (Local Area Network) and a USB (Universal Serial Bus) cable, so that the host system HS sends a print request to the printing apparatus 1001 and transmits the print data. Particularly, the host system HS generates and transmits print data for the MICR printing and to the printing apparatus 1001.

Further, the communication control section 1031 analyzes the received communication data from the host system HS to extract the print data so as to transmit the extracted print data to the engine control section 1039 via the CPU 1036, and transmits transmission data to the host system HS via a communication line.

The engine control section 1039 receives image data that have been received from the host HS by the communication control section 1031 and that have been image-processed when necessary and transmits the image data to the engine 1050. Further, the engine control section 1039 controls and causes the engine 1050 to perform an image printing process based on the received image data.

The ROM 1037 stores basic programs for controlling the engine 1050 to perform a printing operation in the printing apparatus 1001, necessary system data, an MICR print control program described below, and necessary data. The CPU (determination means, control means) 1036 controls various sections of the printing apparatus 1001 based on the programs stored in the ROM 1037 to perform not only basic processes but also an MICR print control process described below, while using the RAM 1032 as working memory.

The NVRAM (password storage means) 1033 preserves the contents of the NVRAM 1033 even when the power to the printing apparatus 1001 is turned OFF. The NVRAM 1033 stores contents of a mode instruction (not shown) from the operations panel 1060, various information items about the operations (such as operation logs) of the printing apparatus 1001, and various information items necessary for an MICR image forming control process described below such as user information item about users who are allowed to perform the MICR printing, user identification information items, such as password, to identify users and the like.

The operations panel control section 1034 is connected to the operations panel 1060, monitors the operations of the operations panel 1034, and reports the contents of the operations to the CPU 1036. Further, the operations panel control section 1034 causes the operations panel 1060 to display the display data transmitted from the CPU 1036 and controls so as to turn ON/OFF or blink an LED (Light Emitting Diode) on the operations panel 1060.

The password control section 1035 is connected to a password input section (password input means) 1041, through which a user allowed to perform the MICR printing in the printing apparatus 1001 inputs the password as the user authentication information registered in the NVRAM 1033. The password input section 1041 may be achieved by using the operations panel 1060 or by a dedicated input section. The user authentication information data (which is a password in this embodiment) may be a fixed character string including figures, symbols, characters and the like. As the user authentication information (password), a so-called "passcode" capable of automatically generating new passwords, for example, every several seconds or every several minutes may also be used.

Figure 5:
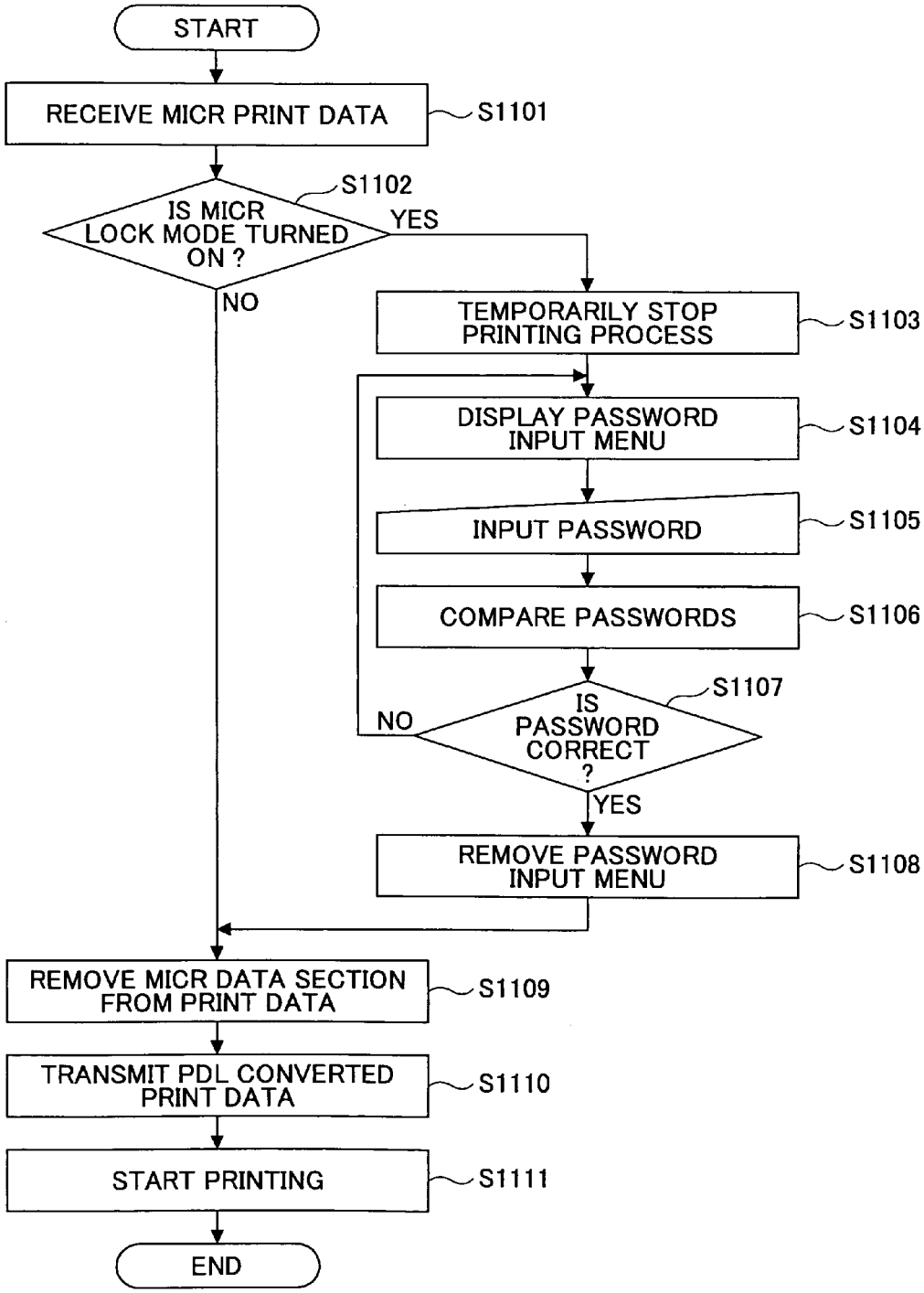
FIG. 5 is a flowchart showing an MICR printing control process in the printing apparatus of FIG. 1.

Further, when the MICR print data are transmitted from the host system HS, the password control section 1035 turns ON or OFF an MICR lock mode (MICR image forming control processing function) which determines whether the password authentication process is performed before the MICR print data are printed. More specifically, as shown in FIG. 5, when the MICR lock mode is turned ON, the password authentication process is performed before the MICR print data are printed. On the other hand, when the MICR lock mode is turned OFF, the MICR print data are printed without performing the password authentication process. The operation to turn ON/OFF the MICR lock mode may be performed by using the MICR lock mode ON/OFF key on the operations panel 1060. However, the MICR lock mode may be turned ON/OFF by operating on the password input section 1041. When the MICR lock mode is turned ON/OFF from the operations on the operations panel 1060, when an MICR lock mode switching mode is selected, ON/OFF display of the MICR lock mode is displayed on the display of the operations panel 1060. Then, the ON/OFF setting of the MICR lock mode may be alternately selected and set by pushing the ON/OFF setting key (MICR lock mode ON/bFF key).

The HDD 1038 is a large-capacity storage medium storing print data with respect to each print job. Further, the HDD 1038 stores necessary programs, other data and the like.

The engine control section 1039 acquires cartridge information items such as a type of process cartridge 1020 (i.e., the normal-printing process cartridge or the MICR-printing process cartridge) and determines whether the process cartridge 1020 inserted in the printing apparatus 1001 is the normal-printing process cartridge or the MICR-printing process cartridge. The CPU 1036 controls to store the result of the determination of the type of the process cartridge 1020 into the NVRAM 1033. By operating in this way, it may become possible to determine whether the normal-printing process cartridge or the MICR-printing process cartridge is inserted as the process cartridge 1020 of the printing apparatus 1001 and display the determination result on the display of the operations panel 1060.

The program recording medium 1070 is removably inserted into the medium control section 1040. The program recording medium 1070 is a computer-readable recording medium such as ROM, EEPROM (Electrically Erasable and Programmable Read Only Memory), EPROM, flash memory, a flexible disk, CD-ROM (Compact Disk Read Only Memory), CD-RW (Compact Disk Rewritable), DVD (Digital Video Disk), SD (Secure Digital) Card, and MO (Magneto-Optical Disk), so that the printing apparatus 1001 can read and execute the programs recorded in the program recording medium 1070. By reading the image forming control program to achieve the image forming control method according to the embodiment of the present invention from the program recording medium 1070 and loading the image forming control program to the ROM 1037 and the HDD 1038, it may become possible to constitute an image forming apparatus capable of executing an image forming control method in the MICR printing described below. The image forming control program is a computer-readable program written in, for example, a legacy programming language such as assembler, C, C++, Java (registered trademark) or the like or an object-oriented programming language and may be stored in the program recording medium 1070 and distributed via the recording medium described above.

Figure 3:
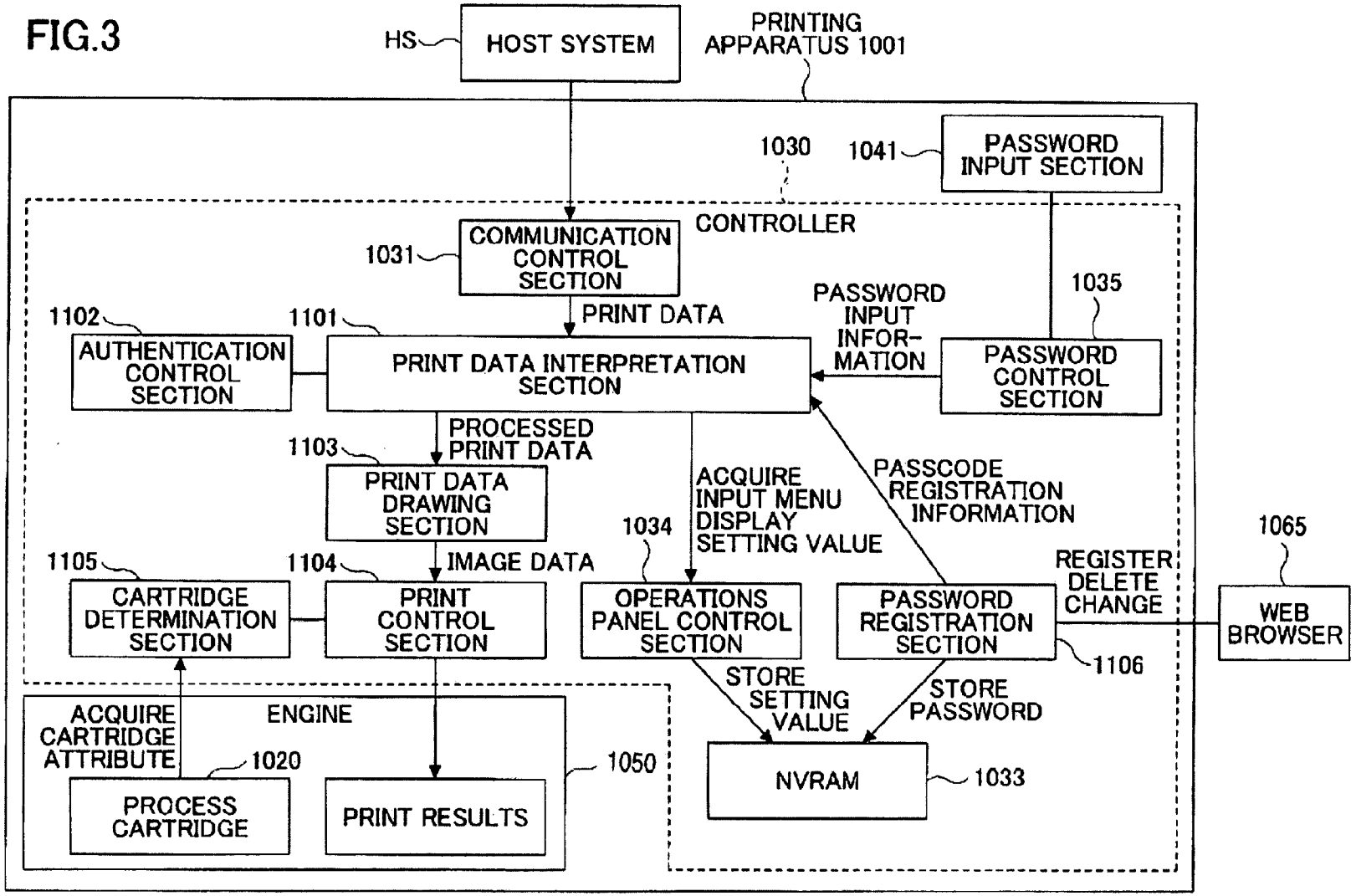
FIG. 3 is a functional block diagram of the printing apparatus of FIG. 1.

By loading the basic programs and the image forming control program into the printing apparatus 1001, it may become possible to constitute the functional blocks as shown in FIG. 3 in the printing apparatus 1001. As shown in FIG. 3, the printing apparatus 1001 includes a print data interpretation section (print data determination means, control means) 1101, an authentication control section (determination means) 1102, a print data drawing section 1103, a print control section 1104, a cartridge determination section (cartridge determination means) 1105, a password registration section (password registration control means) 1106 and the like, so that along with other sections such as the communication control section 1031, the password control section 1035, the operations panel control section 1034, and the NVRAM 1033, not only a normal printing control process for printing the normal print data but also an MICR printing control process for printing the MICR print data can be performed.

Figure 4:
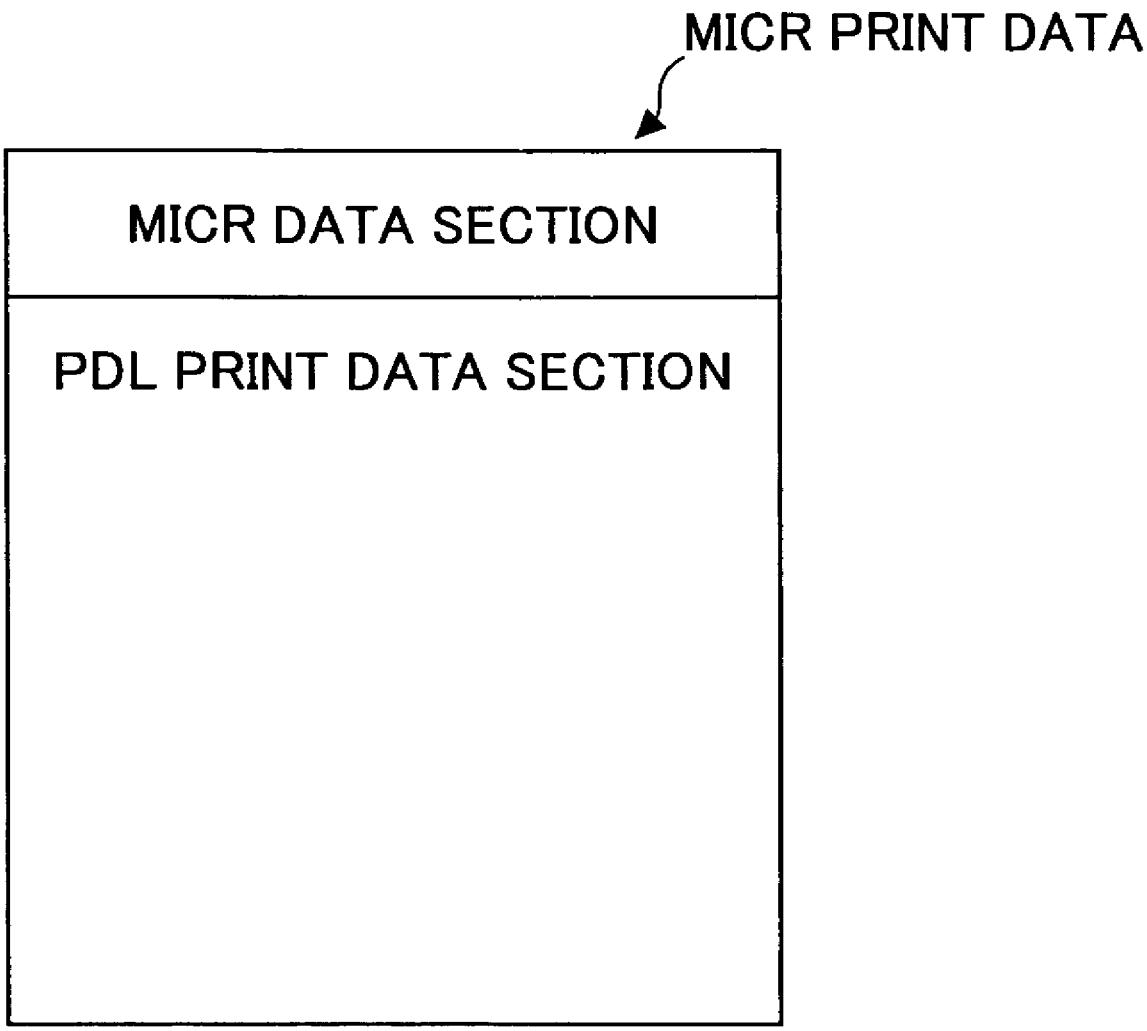
FIG. 4 shows an exemplary data configuration of print data of MICR printing.

Namely, the print data interpretation section 1101 determines the type of the print data transmitted from the host system HS to the communication control section 1031, and, when the MICR printing is performed, performs a password management process and controls the execution of the MICR printing. More specifically, in MICR printing, the MICR print data transmitted from the host HS includes an MICR data section which is attached to the general print data written in PDL (Page Description Language) as shown in FIG. 4. This MICR data section includes data indicating that the print data are for MICR printing. The MICR data section may be arranged to be automatically added to print data in the host system HS provided that the host system HS is exclusively dedicated to handle the MICR print data to be printed as important documents such as checks and bills. Otherwise, it may become necessary for a user to add this MICR data section to explicitly designating that the print data are for the MICR printing by using, for example, a user interface menu provided by printer driver software or the like. The MICR data section is provided in a predetermined position in the print data (for example, a header portion as shown in FIG. 4). As the data of the MICR data section, a password for MICR (data including a predetermined character string such as "MICRPW=**") may be used. The print data interpretation section 1101** determines whether the print data are for MICR printing based on whether the MICR data section is added to the print data (print data determination process).

When it is determined that the received print data are for the MICR printing, the print data interpretation section 1101 further determines whether the MICR lock mode is turned ON or OFF. When it is determined that the MICR lock mode is turned ON, the print data interpretation section 1101 temporarily stops the process for printing the received print data and causes the operations panel control section 1034 to display a password input menu (notification output) to perform a notification process to request password input. When the password is input through the password input section 1041, the password control section 1035 acquires the input data as the password and transmits the acquired input data (password) to the print data interpretation section 1101 (password input process).

On the other hand, the print data interpretation section 1101 transmits the input password to the authentication control section 1102. The authentication control section 1102 performs a user authentication process (determination process) by acquiring the password of the user registered in advance in the NVRAM 1033 and comparing the input password with the password registered in the NVRAM 1033. Then, the authentication control section 1102 reports the authentication result to the print data interpretation section 1101 (determination process).

When the authentication result shows that a user is not authenticated (NG), the print data interpretation section 1101 discards the print data and aborts the printing process. On the other hand, when the authentication result shows that the user is successfully authenticated (OK), the print data interpretation section 1101 performs necessary processing processes including an MICR identification data removing process which removes the MICR data section from the received print data so as to transmit only the print data section written in PDL (PDL print data section) as shown in FIG. 4 to the print data drawing section 1103 (MICR image forming control process).

The print data drawing section 1103 converts the received print data into image data (such as CMYK image data) so as to be processed by the print control section 1104 and transmits the converted image data to the print control section 1104 so that the print control section 1104 controls the engine 1050 to obtain print results by printing the print data onto the sheet P.

Further, the print control section 1104 receives the determination result whether the inserted process cartridge 1020 is the normal-printing process cartridge or the MICR-printing process cartridge from the cartridge determination section 1105. In this case, the cartridge determination section 1105 determines whether the inserted process cartridge 1020 is the normal-printing process cartridge or the MICR-printing process cartridge by communicating with the inserted process cartridge 1020 by wire or wirelessly so as to acquire the information (cartridge attribute) of the process cartridge 1020 from a memory incorporated in the process cartridge 1020 and transmits the determination result to the print control section 1104 (cartridge determination process).

The print control section 1104 determines whether a type of the printing to be performed is the normal printing or the MICR printing based on the received determination result from the cartridge determination section 1105 and performs printing control. Further, the print control section 1104 reports the determination result received from the cartridge determination section 1105 to the print data interpretation section 1101 so that the print data interpretation section 1101 controls so as to display the type of the process cartridge 1020 on the display of the operations panel 1060.

The password registration section 1106 accepts (receives) a request to register/delete/change the password by communicating with a Web browser 1065 of the host system HS or the like via a network such as the Internet. Based on the accepted request to register/delete/change the password, the password registration section 1106 registers the password into the NVRAM 1033, deletes or changes the password registered in the NVRAM 1033 (password registration control process), and transmits the registered information of the password in the NVRAM 1033 to the print data interpretation section 1101.

Namely, in the printing apparatus 1001 according to this embodiment of the present invention, an editing such as registering, deleting, and changing the password is allowed to be performed only through the Web browser 1065. Therefore, the password cannot be edited by operating the operations panel 1060 or password input section 1041.

As describe above, in the MICR print data, the MICR data section is provided (added) in the header portion of the print data and the password is generally included in the MICR data section. Therefore, it may become possible to perform the MICR printing of the print data only when the authentication control section 1102 determines that the password in the MICR data section corresponds to both the password registered in the NVRAM 1033 and the password input through the password input section 1041.

Next, an operation of the printing apparatus 1001 according to this embodiment of the present invention is described. As described above, in the printing apparatus 1001 according to this embodiment of the present invention, it is determined whether the print data received from the host system HS is the MICR print data, and only when the MICR lock mode is turned ON, the MICR printing is controlled to be performed by performing the password authentication process.

Namely, in the printing apparatus 1001 according to this embodiment of the present invention, in a case where the cartridge determination section 1105 determines that the inserted process cartridge 1020 in the main body chassis 1002 is the normal-printing process cartridge, when the communication control section 1031 determines that the print data received from the host system HS is the normal print data, the print data interpretation section 1101 performs necessary processes on the print data and transmits the processed print data to the print data drawing section 1103. The print data drawing section 1103 converts the received print data into image data so as to be processed by the print control section 1104 and transmits the converted image data to the print control section 1104 so that the print control section 1104 controls the engine 1050 to obtain print result.

On the other hand, when the cartridge determination section 1105 determines that the inserted process cartridge 1020 in the main body chassis 1002 is the MICR-printing process cartridge and reports the determination result to the print control section 1104 and the print data interpretation section 1101, the print data interpretation section 1101 goes into an MICR printing control mode to perform the MICR printing control process shown in FIG. 5.

FIG. 5 is a flowchart showing an image forming control process for the MICR print data according to this embodiment of the present invention. As shown in FIG. 5, in step S1101, when the communication control section 1031 of the printing apparatus 1001 receives the print data from the host HS, the communication control section 1031 transmits the received print data to the print data interpretation section 1101. Then, in this case, the print data interpretation section 1101 determines that the print data are the MICR print data by determining whether the MICR data section is added to the print data. When the print data interpretation section 1101 determines that the received print data are the MICR print data, the process goes to step S1102. In step S1102, it is determined whether the MICR lock mode is turned ON or turned OFF.

When, in step S1102, it is determined that the MICR lock mode is turned ON, the process goes to step S1103. In step S1103, the print data interpretation section 1101 temporarily stops the printing process. In step 1104, the print data interpretation section 1101 causes the operations panel control section 1034 to display a menu to request password input (password input menu). In step S1105, a user who knows the password and who transmitted the MICR print data from the host system HS inputs the password. In step S1106, the password control section 1035 transmits the input password to the authentication control section 1102 via the print data interpretation section 1101. The authentication control section 1102 compares the password registered in the NVRAM 1033 with the input password. In step S1107, the authentication control section 1102 verifies the consistency between the password registered in the NVRAM 1033 and the input password to determine whether the input password is correct (password authentication process). When, in step S1107, it is determined that the input password is not correct, the process goes back to step S1104 to wait for a next password input and compare the next password with the password registered in the NVRAM 1033 to determine whether the password is correct (in steps S1104 through S1107).

When, in step S1107, it is determined that the input password is correct, the process goes to step S1108. In step S1108, the authentication control section 1102 reports the determination result to the print data interpretation section 1101. Then, the print data interpretation section 1101 causes the operations panel control section 1034 to remove the password input menu from the display of the operations panel 1060. In step S1109, necessary processes are performed on the MICR print data, the processes including the process of removing the MICR data section from the MICR print data. The processed print data written in PDL are transmitted to the print data drawing section 1103. In step S1110, the print data drawing section 1103 converts the processed print data into image data (such as CMYK image data) that can be printed by the engine 1050, and transmits the converted image data to the print control section 1104. In step S1111, based on the converted image data, the print control section 1104 causes the engine 1050 to perform the MICR printing for printing important documents such as checks and the process ends.

When, in step S1102, it is determined that the MICR lock mode is turned OFF, the print data interpretation section 1101 determines that the print data are allowed to be printed, and the process directly goes to step S1109 to perform the same process in steps S1109 though S1111 as described above.

As described above, in the printing apparatus 1001 according to this embodiment of the present invention, when an image is printed on the sheet P based on the received print data by using a removably inserted process cartridge 1020, it is determined whether the MICR-printing process cartridge is inserted as the process cartridge 1020. When it is determined that the MICR-printing process cartridge is inserted as the process cartridge 1020, the process for printing the received print data is temporarily stopped and the password input menu is displayed as notification output. When the password is input through the password input section 1041 in response to the notification output, the authentication control section 1102 compares the password registered in the NVRAM 1033 with the input password. The data interpretation section 1101 determines whether the print data are allowed to be printed based on the comparison result. When it is determined that the print data are allowed to be printed, the temporarily stopped MICR image forming control process for printing the print data is performed (restarted).

By operating in this way, it may become possible to allow only a user who knows the password to print the MICR print data and securely prevent the print result of the MICR printing such as checks and bills from being picked up and taken away by a person other than the user.

Further, it is determined whether the print data are the MICR print data based on whether the MICR data section indicating that the print data are the MICR print data are added to the received print data. When it is determined that the print data is the MICR print data, the MICR printing control process for printing the print data is allowed to be performed and the MICR data section is removed from the print data.

Therefore, it may become possible to perform the MICR printing process including the password authentication process when printing the MICR print data that should not be picked up and taken away by a person other than the user, and otherwise, perform the normal printing process when printing other print data, thereby improving the usability of the printing apparatus 1001.

Further, in the printing apparatus 1001 according to this embodiment of the present invention, the MICR printing control process may be performed only when the MICR printing control process function is turned ON.

Therefore, it may become possible to perform printing processes in accordance with a user usage condition, thereby improving the usability of the printing apparatus 1001.

Further, in the printing apparatus 1001 according to this embodiment of the present invention, the password can be registered into the NVRAM 1033 and the password registered in the NVRAM 1033 can be removed and changed in response to the request from a predetermined apparatus such as an external computer.

Therefore, it may become possible to perform a centralized control method in which, for example, alone computer designated to be used for MICR printing can manage the MICR printing in the printing apparatus 1001.

Further, in the printing apparatus 1001 according to this embodiment of the present invention, the password input menu may be displayed on the operations panel 1060 and a predetermined lamp such as an LED on the operations panel 1060 may be turned ON or made to blink as the notification output.

Therefore, even if a printing apparatus 1001 has relatively poor operability, it may become possible to appropriately perform the MICR printing process with the password authentication process. As a result, it may become possible to improve the usability of the printing apparatus 1001 and prevent the MICR printing result being picked up and taken away by a person other than a user who printed the MICR printing result.

This embodiment of the present invention may be used in an image forming apparatus including a printing apparatus and multi-functional peripheral, an image forming control method, an image forming control program, and a recording medium capable of performing the MICR printing in which picking up and taking away the important documents such as checks and bills may be better prevented.

Second Embodiment

Figure 6:
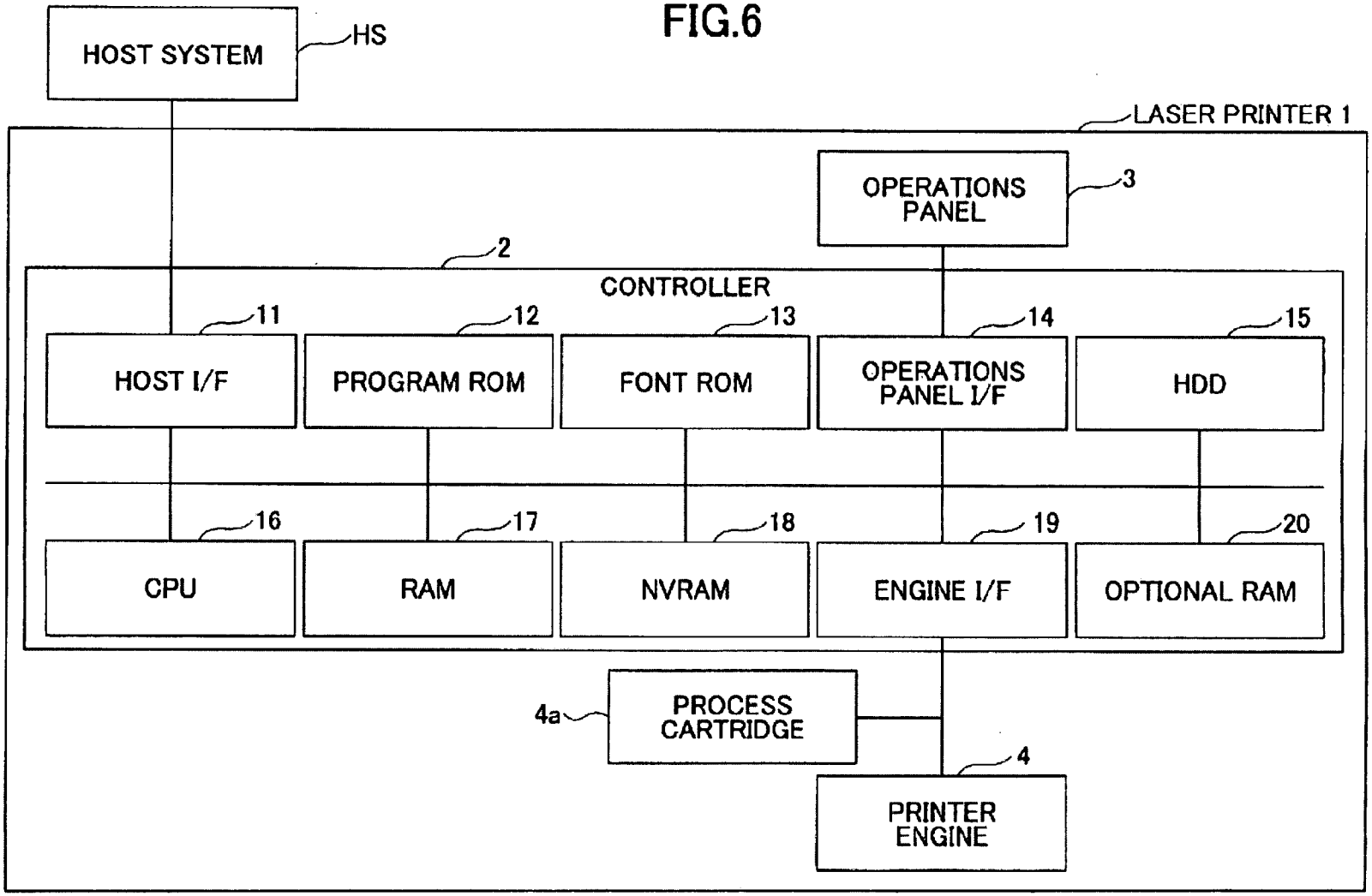
FIG. 6 is a block diagram showing a main part of a laser printer according to an embodiment of the present invention.

FIGS. 6 through 12 show configurations of an image forming apparatus, an image forming control method, an image forming control program, and a recording medium according to an embodiment of the present invention. FIG. 6 is a block diagram showing a main part of a laser printer 1 used in the image forming apparatus, the image forming control method, the image forming control program, and the recording medium according to the embodiment of the present invention.

As shown in FIG. 6, the laser printer 1 includes a controller 2, an operations panel 3, a printer engine 4 and the like and is connected to a host system HS such as a host computer. The laser printer 1 may be, for example, a color printer, a color copier, color multi-functional peripheral or the like as an image forming apparatus.

As a printer engine (image forming means) 4, the laser printer 1 includes a feed roller, a resist roller, a transfer roller, a guide plate and the like disposed along the direction of a sheet feeding path formed from a sheet feeding cassette in a sheet feeding section for feeding a sheet in the main body chassis (not shown) of the laser printer 1. The printer engine 4 includes a fixing section disposed on the downstream side of the sheet feeding path in the main body chassis. The fixing section fixes a toner image onto a sheet to the sheet by heating and pressing the sheet on which the toner image is formed, and feeds the sheet to a discharge roller. The discharge roller discharges the sheet on which the image is formed to a discharge section.

Then, in the printer engine 4, the process cartridge for normal printing and the process cartridge for MICR printing can be exchangeably inserted as a process cartridge 4*a*. When the process cartridge for MICR printing is inserted as the process cartridge 4*a*, the MICR printing can be performed. When the MICR printing is performed, since a general purpose of the MICR printing is to print checks, bills and the like, dedicated sheets in accordance with the purpose of the MICR printing are accumulated in the sheet feeding cassette. Further, in the printer engine 4, an optical writing unit including a polygon motor, a polygon mirror, an Fθ lens, a laser diode as a light source, a mirror and the like is disposed in the main body chassis, so that an optical writing beam modulated in accordance with the data to be printed emits from the laser diode. In the laser printer 1, the process cartridge 4*a* is removably provided on the upper side of the sheet feeding path formed in the main body chassis. The process cartridge 4*a* includes a cartridge case. In the cartridge case, a photosensitive body, a charging roller, a cleaning section, a waste toner collecting section, a developing/toner storing section and the like are provided and integrally constitute the process cartridge 4*a*. The process cartridge 4*a* is removably provided in the printer engine 4 of the laser printer 1 in a manner so that the photosensitive body of the process cartridge 4*a* faces and is in contact with the transfer roller. In between the photosensitive body and the transfer roller, a sheet is entered that has been separated one by one from the sheet feeding cassette by a sheet feeding roller, fed to the resist roller by the feed roller, and fed by the resist roller after the timing is adjusted by the resist roller. By irradiating the laser light emitted from the optical writing unit onto the photosensitive body, a latent image is formed on the photosensitive body. When the latent image passes the position of the developing/toner storing section, toner is supplied from the developing/toner storing section so that the latent image is visualized to form a toner image on the photosensitive body. After the photosensitive body further rotates so that the toner image on the photosensitive body faces the transfer roller, the toner image is transferred onto the sheet entered into between the transfer roller and the photosensitive body. The printer engine 4 feeds the sheet on which the toner image is transferred to the fixing section. The fixing section presses and heats the fed sheet by a fixing roller heated at a fixing temperature and a pressing roller to fix the toner image onto the sheet to the sheet. The printer engine 4 feeds the sheet on which the fixing of the toner image is completed to the upper side of the discharge section by using the discharge roller. After the transfer is finished, the photosensitive body of the process cartridge 4*a* further rotates so that residual toner is removed by the cleaning section and a waste toner collecting section so that the photosensitive body can be used again for the image forming process described above. In the following descriptions, when needed, the term "image forming" may be referred to as "printing (or print)", and the term "image forming process" may be referred to as "printing process".

Further, in the laser printer 1, as the process cartridge 4*a*, each of a normal-printing process cartridge used for the normal printing and an MICR-printing process cartridge used for the MICR printing can be exchangeably provided (inserted).

Further, the laser printer 1 includes a cartridge determination section 105 determining whether the process cartridge 4*a* provided in the laser printer 1 is the normal-printing process cartridge or the MICR-printing process cartridge by acquiring information by wire (by, for example, connector connection) or wirelessly (by wireless communication such as RFID (Radio Frequency-Identification)). Particularly, the cartridge determination section 105 may determine that the MICR-printing process cartridge is provided (inserted) by acquiring information about the MICR-printing process cartridge from, for example, a memory (such as a memory tag and an IC chip) incorporated in the MICR-printing process cartridge. Namely, at least, the MICR-printing process cartridge incorporates a memory including cartridge information (identification information) indicating that the cartridge is for MICR printing. Further, as the memory, non-volatile memory that can preserve the stored data without supplied power may be used.

Further, the operations panel 3 (see FIG. 6) includes various operation keys necessary for operating the laser printer 1 and a display (such as a liquid crystal display), the operation keys including a start key, a stop key, ten keys, an image-quality setting key, an MICR printing setting key and the like. Those operations keys are also used for inputting a password. The display displays instruction contents input via the operation keys, various information to notify a user from the laser printer 1, and especially, various information necessary for an image forming control process to perform an image forming control method in the MICR printing, such as a password input menu. In that sense, the operations panel 3 serves as password input means and password request means.

The controller 2 is a generic term of a control mechanism that converts print data from the host system HS into image data in accordance with a control mode currently activated and a control code from the host system HS. Further, the controller 2 may include a host I/F 11, program ROM (Read Only Memory) 12, font ROM 13, an operations panel I/F 14, a HDD (Hard Disk Drive) 15, a CPU (Central Processing Unit) 16, RAM (Random Access Memory) 17, NVRAM (Non-Volatile Random Access Memory) 18, and an engine I/F 19, optional RAM 20 and the like. Those elements are connected to each other via a bus 21.

The host system HS is connected to the host I/F 11. Via the host I/F 11, the laser printer 1 receives printing jobs (i.e., authentication-requiring MICR printing job, normal MICR printing job, and normal printing job) transmitted from the host system HS and including a control signal and data to be printed. Further, via the host I/F 11, the laser printer 1 outputs a signal and data such as status signal to the host system HS.

The program ROM 12 stores programs for processing and managing data in the controller 2 and controlling peripheral modules. More specifically, the program ROM 12 stores various programs such as basic processing programs of the laser printer 1 and an image forming control program for performing an image forming control method described below and various data necessary for executing the various programs.

In the font ROM 13, various fonts used in printing in the laser printer 1 are stored in advance and read by the CPU 16 to be used in a printing (image forming) process.

The laser printer 1 performs the image forming control method by appropriately controlling the performing order of printing jobs described below by loading the image forming control program from the program ROM 12 or the like, the image forming control program being for performing the image forming control method and being recorded in a computer-readable recording medium such as ROM, EEPROM (Electrically Erasable and Programmable Read Only Memory), EPROM, flash memory, a flexible disk, CD-ROM (Compact Disk Read Only Memory), CD-RW (Compact Disk Rewritable), DVD (Digital Video Disk), SD (Secure Digital) Card, and MO (Magneto-Optical Disk). The image forming control program is a computer-readable program written in, for example, a legacy programming language such as assembler, C, C++, Java (registered trademark) or the like or an object-oriented programming language and may be stored in the recording medium and distributed via the recording medium described above.

The operations panel I/F 14 is connected to the operations panel 3 and receives and transmits signals communicated between the controller 2 and the operations panel 3.

The HDD (storage means) 15 is a large-capacity data storage device storing print data especially authentication-requiring MICR print data.

The CPU (control means, determination means) 16 controls various sections of the laser printer 1 based on the programs stored in the program ROM 12 to perform not only the printing process (image forming process) but also an image forming control process described below, while using the RAM 17 as working memory.

The RAM 17 serves as the working memory for the CPU 16. Also The RAM 17 serves as, for example, a buffer for managing print data from the host system HS in units of pages and a bit map memory to which drawing data (video data) is loaded, the drawing data being an actual image pattern (printing pattern) converted from the data stored in the buffer.

The NVRAM (password storage means) 18 preserves the contents of the NVRAM 18 even when the power to the laser printer 1 is turned OFF. Therefore, data to be preserved even when the power to the laser printer 1 is turned OFF are stored in the NVRAM 18 under the control of the CPU 16.

The optional RAM 20 is a so-called removable auxiliary memory and used when, for example, the RAM 17 runs out of space.

The engine I/F 19 is connected to the printer engine 4 and transmits and receives a control signal and a video signal transmitted from the controller 2 to printer engine 4 and a status signal transmitted from the printer engine 4 to the controller 2.

The printer engine 4 performs an image forming process (printing process) in an electrophotographic method based on the received video signal (image signal) and the control signal from the controller 2 via the engine I/F 19. Further, as described above, depending on whether the inserted process cartridge 4*a* is the MICR-printing process cartridge or the normal-printing process cartridge, the printer engine 4 selects and performs the MICR printing (authentication-requiring MICR printing and normal MICR printing) or the normal printing which is not one of the MICR printings, respectively.

Figure 7:
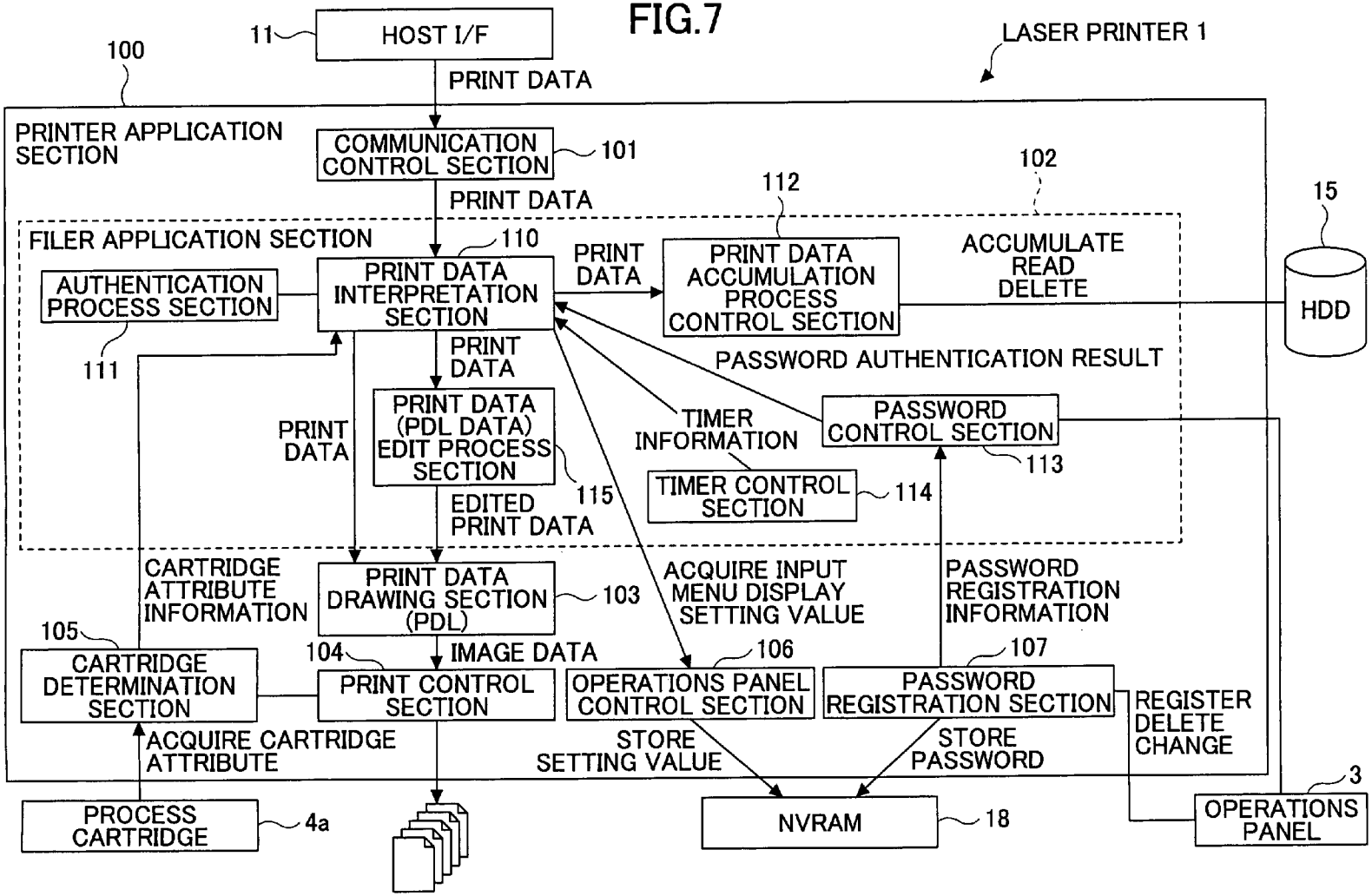
FIG. 7 is a functional block diagram of the laser printer in FIG. 6.

As shown in FIG. 7, by loading and executing the image forming control program, a printer application section 100 is provided in the laser printer 1. The printer application section 100 includes a communication control section 101, a filter application section 102, a print data drawing section (written in PDL) 103, a print control section 104, the cartridge determination section 105, an operations panel control section 106, a password registration section 107 and the like. The filter application section 102 includes a print data interpretation section 110, an authentication process section 111, a print data accumulation process control section 112, a password control section 113, a timer control section 114, a print data (written in PDL) edit process section 115 and the like.

The communication control section 101 is connected to the host system HS via a communication line such as a LAN (Local Area Network) and a USB (Universal Serial Bus) cable by the host I/F 11, so that the host system HS sends a print request to the laser printer 1 and transmits the print data. Particularly, the host system HS generates print data for the MICR printing and transmits a printing job including data of the MICR printing (the authentication-requiring MICR printing and the normal MICR printing) and the normal printing which is not one of the MICR printings to the laser printer 1.

In the filter application section 102, the print data interpretation section 110 receives the printing job such as print data transmitted from the host system HS and received by the communication control section 101. Then, the filter application section 102 analyzes the printing job from the host system HS and extracts the print data and transmits the extracted print data to the print data accumulation process control section 112 and the print data edit process section 115. Further, the filter application section 102 determines whether the print data (especially the authentication-requiring MICR print data) can be printed based on the result of an authentication process by the authentication process section 111.

The authentication process section 111, when the print data received by the print data interpretation section 110 is the authentication-requiring MICR print data, verifies the authentication of the authentication-requiring MICR print data and sends the authentication result to the print data interpretation section 110.

The print data interpretation section 110 determines whether the print data received from the communication control section 101 is data for normal printing (hereinafter may be referred to as "normal print data") or data for MICR printing (hereinafter may be referred to as "MICR-print data"). If it is determined that the print data received from the communication control section 101 is the MICR-print data, the print data interpretation section 110 further determines whether the data received from the communication control section 101 is data for the authentication-requiring MICR printing which requires an authentication process (hereinafter may be referred to as "authentication-requiring MICR print data") or data for the normal MICR printing (hereinafter may be referred to as "normal MICR print data"). As a result, when it is determined that the print data are the authentication-requiring MICR print data, the print data interpretation section 110 sends an instruction to the print data accumulation process control section 112 to accumulate the print data (print job data). Further, at an appropriate timing, the print data interpretation section 110 causes the operations panel control section 106 to display a password input menu on the display. The password control section 113 verifies the consistency between the password input by a user through the password input menu and the password registered in the NVRAM 18 in advance. Depending on the verification result by the password control section 113, the print data interpretation section 110 sends an instruction to the print data accumulation process control section 112 to read or remove the print data.

Under the control of the print data interpretation section 110, the print data accumulation process control section 112 stores the print data (especially, authentication-requiring MICR print data) in the HDD 15, reads the print data, removes the stored print data and the like.

Further, when it is determined that the print data are not the authentication-requiring MICR print data that require the authentication process but the normal MICR print data that do not require the authentication process or the normal print data that is processed by using the normal-printing process cartridge as the process cartridge 4*a*, as described below, the print data interpretation section 110 temporarily stops the authentication process of the authentication-requiring MICR print data and performs with priority the image forming control process that may achieve the image forming control method to perform a printing process of the normal MICR print data or the normal print data.

Further, in a case where the print data are printed and when an editing process is required to be performed on the print data, the print data interpretation section 110 controls so that the print data are transmitted to the print data edit process section 115. On the other hand, when no editing process is required to be performed on the print data, the print data interpretation section 110 controls so that the print data are directly transmitted to the print data drawing section 103.

The print data edit process section 115 edits the print data and a print condition in accordance with the conditions (such as inserted condition of the process cartridge 4*a*) of the laser printer 1, and sends the edited result to the print data drawing section 103.

The print data drawing section 103 converts the print data received from the print data interpretation section 110 and the print data received from the print data edit process section 115 into drawing data (bitmap data) that can be processed by the printer engine 4 and loads the converted drawing data into the RAM 17 in units of pages so as to transmit the converted drawing data to the print control section 104.

Figure 8:
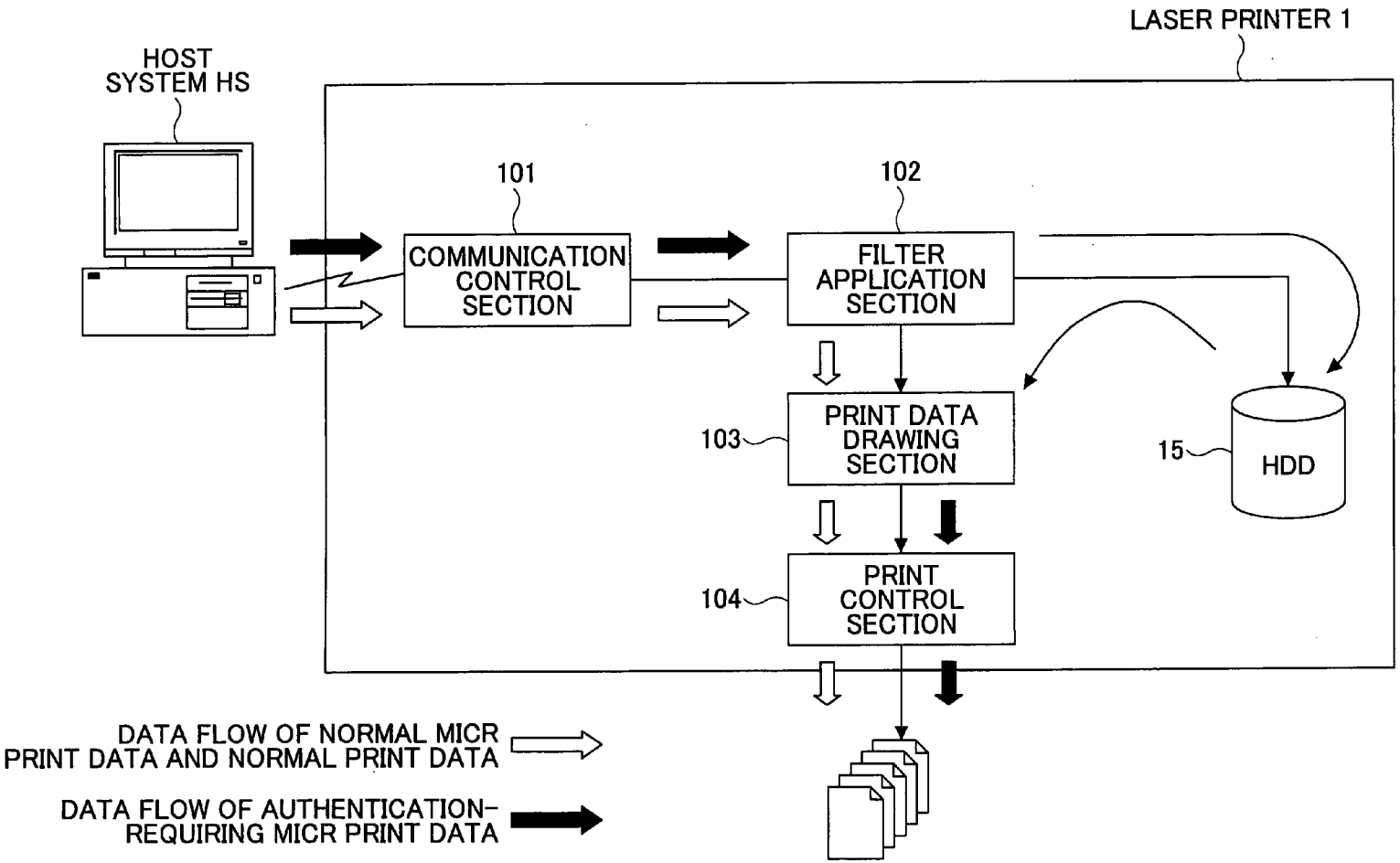
FIG. 8 is a diagram showing a data flow of print data in the laser printer in FIG. 6.

The print control section 104 controls and causes the printer engine 4 to print the print data received from the print data drawing section 103 onto a sheet to obtain a print result as shown in FIG. 8.

Further, the print control section 104 receives the determination result whether the inserted process cartridge 4*a* is the normal-printing process cartridge or the MICR-printing process cartridge from the cartridge determination section 105. Namely, the cartridge determination section 105 performs a cartridge determination process which determines whether the process cartridge 4*a* is the normal-printing process cartridge or the MICR-printing process cartridge by, for example, as described above, connecting by wire or wirelessly to the process cartridge 4*a* for communications to obtain the information about the process cartridge 4*a* (attribute of the cartridge) from a memory incorporated in the process cartridge 4*a* and transmits the determination result to the print control section 104 and the print data interpretation section 110.

Based on the received determination result from the cartridge determination section 105, the print data interpretation section 110 performs a print control process (image forming control process) by determining whether the print data are the normal print data or the MICR-print data, or, if the print data are the MICR-print data, authentication-requiring MICR print data or normal MICR print data. Further, when necessary, the print data interpretation section 110 causes the operations panel control section 106 to display the type of the process cartridge 4*a* (i.e., the normal-printing process cartridge or the MICR-printing process cartridge) and/or the password input menu on the display of the operations panel 3.

Under the control of the print data interpretation section 110, the operations panel control section 106 performs menu display control to display the password input menu and the like on the display of the operations panel 3 and performs a setting value storage process to store the settings of the password input through the operations panel 3, the priority of the print process, timeout time and the like into the NVRAM 18.

The password registration section 107 performs a password registration control process to accept (receive) password registration/remove/change information from the operations panel 3 and the host system HS and, based on the accepted password registration/remove/change information, register the password into the NVRAM 18, and remove and change the registered password. Further, the password registration section 107 transmits registration information of the password stored in the NVRAM 18 to the print data interpretation section 110 via the password control section 113.

The password control section 113 receives the password stored in the NVRAM 18 via the password registration section 107 and verifies the consistency between the password stored in the NVRAM 18 and the password input by a user via the operations panel 3 and reports the verification result to the print data interpretation section 110.

The NVRAM (password storage means) 18 is, as described above, a non-volatile memory that can preserve the stored data even when the power to the laser printer 1 is turned OFF and stores contents of a mode instruction (not shown) from the operations panel 3, various information about the operations (such as operation logs) of the laser printer 1, and various information necessary for an MICR image forming control process described below such as user information about users who are allowed to perform the MICR printing, user identification information, such as passwords, to identify users and the like.

The print data accumulation process control section 112 accumulates the printing job such as print data received from the print data interpretation section 110 into the HDD 15 and controls the reading of the accumulated print data and the like. Especially, the data accumulation process control section 112 controls, for example, the accumulation into and the reading from the HDD 15 of the print data that have been determined as the authentication-requiring MICR print data by the print data interpretation section 110.

The timer control section 114 performs various time measurement processes used in the laser printer 1 such as, especially, starting, measuring, stopping, and resetting the timeout time for waiting for password input.

Namely, as shown in FIG. 8, when the print data are transmitted from the host system HS to the laser printer 1, the communication control section 101 receives the print data. Then, the filter application section 102 determines whether the print data are the authentication-requiring MICR print data or print data other than the authentication-requiring MICR print data (i.e., the normal MICR print data or the normal print data). When it is determined that the print data are the authentication-requiring MICR print data, as shown in black arrows in FIG. 8, after temporarily accumulating the authentication-requiring MICR print data into the HDD 15, the filter application section 102 performs the authentication process. During the authentication process, as shown in sold-while arrows in FIG. 8, if the normal MICR print data or the normal print data are transmitted from the host HS, the filter application section 102 stops the authentication process and transmits with priority the normal MICR print data or the normal print data to the printer engine 4 via the print data drawing section 103 and the print control section 104 to perform a printing process to print the print data on a sheet.

In the laser printer 1, when there are authentication-requiring MICR print data accumulated in the HDD 15, at a predetermined timing when neither normal MICR print data nor normal print data are transmitted from the host system HS as the print data, the password input menu is displayed on the display of the operations panel 3. When the password input via the display of the operations panel 3 is successfully authenticated, the authentication-requiring MICR print data are read from the HDD 15 so that the printing process is performed to print the authentication-requiring MICR print data similar to the above printing process of the print data.

Next, the operation of an embodiment of the present invention is described. As shown in FIGS. 7 and 8, in the laser printer 1 according to the embodiment of the present invention, the authentication-requiring MICR print data takes more time to be allowed to be printed than any other print data (i.e., the normal MICR print data or the normal print data) because the authentication-requiring MICR printing requires the additional authentication process for inputting and authenticating the password. Therefore, the authentication-requiring MICR print data are temporarily accumulated into the HDD 15 and the authentication process is performed at a predetermined timing to be read and printed.

Figure 9:
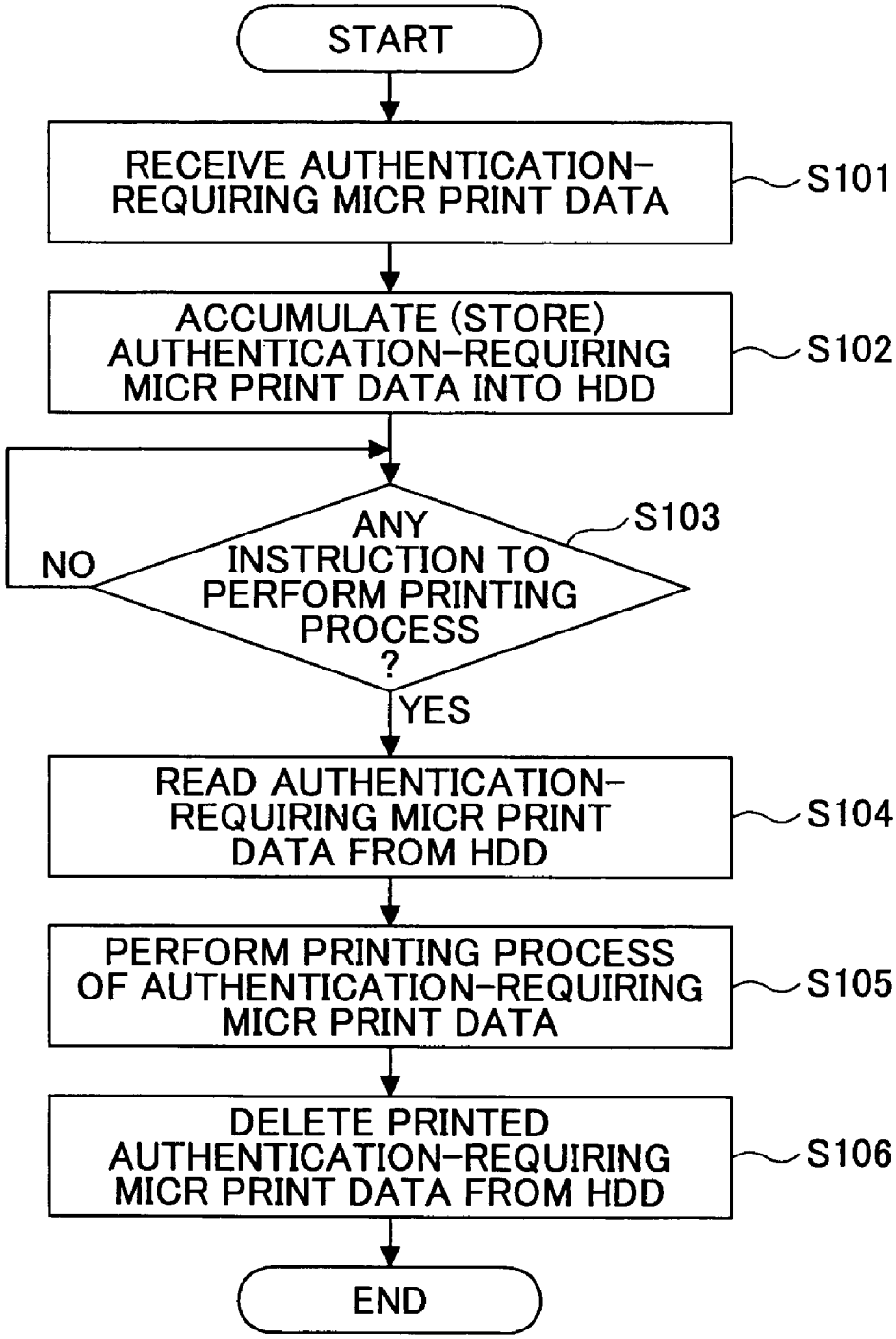
FIG. 9 is a flowchart showing a basic image forming control process of printing authentication-requiring MICR print data.

FIG. 9 is a flowchart showing a process of a basic image forming control process of the authentication-requiring MICR print data. As shown in FIG. 9, in step S101, the communication control section 101 receives the authentication-requiring MICR print data from the host system HS. In step S102, the print data interpretation section 110 temporarily accumulates the authentication-requiring MICR print data into the HDD 15 via the data accumulation process control section 112. In step S103, it is determined whether an instruction to perform a printing process is issued due to, for example, the fact that the predetermined timeout time has elapsed.

When the instruction to perform the printing process is issued (YES) in step S103, the step goes to step S104. In step S104, the print data interpretation section 110 reads the authentication-requiring MICR print data stored in the HDD 15 from the HDD 15 via the data accumulation process control section 112. In step S105, when necessary, the print data edit process section 115 edits the authentication-requiring MICR print data, and the edited authentication-requiring MICR print data are transmitted to the print data drawing section 103; or when no edition is required, the print data drawing section 103 are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the printing process.

In step S106, after the authentication-requiring MICR print data are printed, the print data interpretation section 110 removes the printed authentication-requiring MICR print data from the HDD 15 via the data accumulation process control section 112 to end the process.

As described above, in a case where the laser printer 1 receives the data to be printed at least of which are the authentication-requiring MICR print data and forms the image of the data to be printed, the laser printer 1 determines whether the received print data are the authentication-requiring MICR print data that require performing the authentication process or the normal print data that do not require performing the authentication process. When it is determined that the received data are the authentication-requiring MICR print data, the laser printer 1 temporarily accumulates the received authentication-requiring MICR print data into the HDD 15 and reads the authentication-requiring MICR print data from the HDD 15 at a predetermined timing to form (print) the image of the authentication-requiring MICR print data.

Therefore, it may become possible to improve the degree of freedom in handling the authentication-requiring MICR print data, thereby enabling improving the usability of the laser printer 1.

Figure 10:
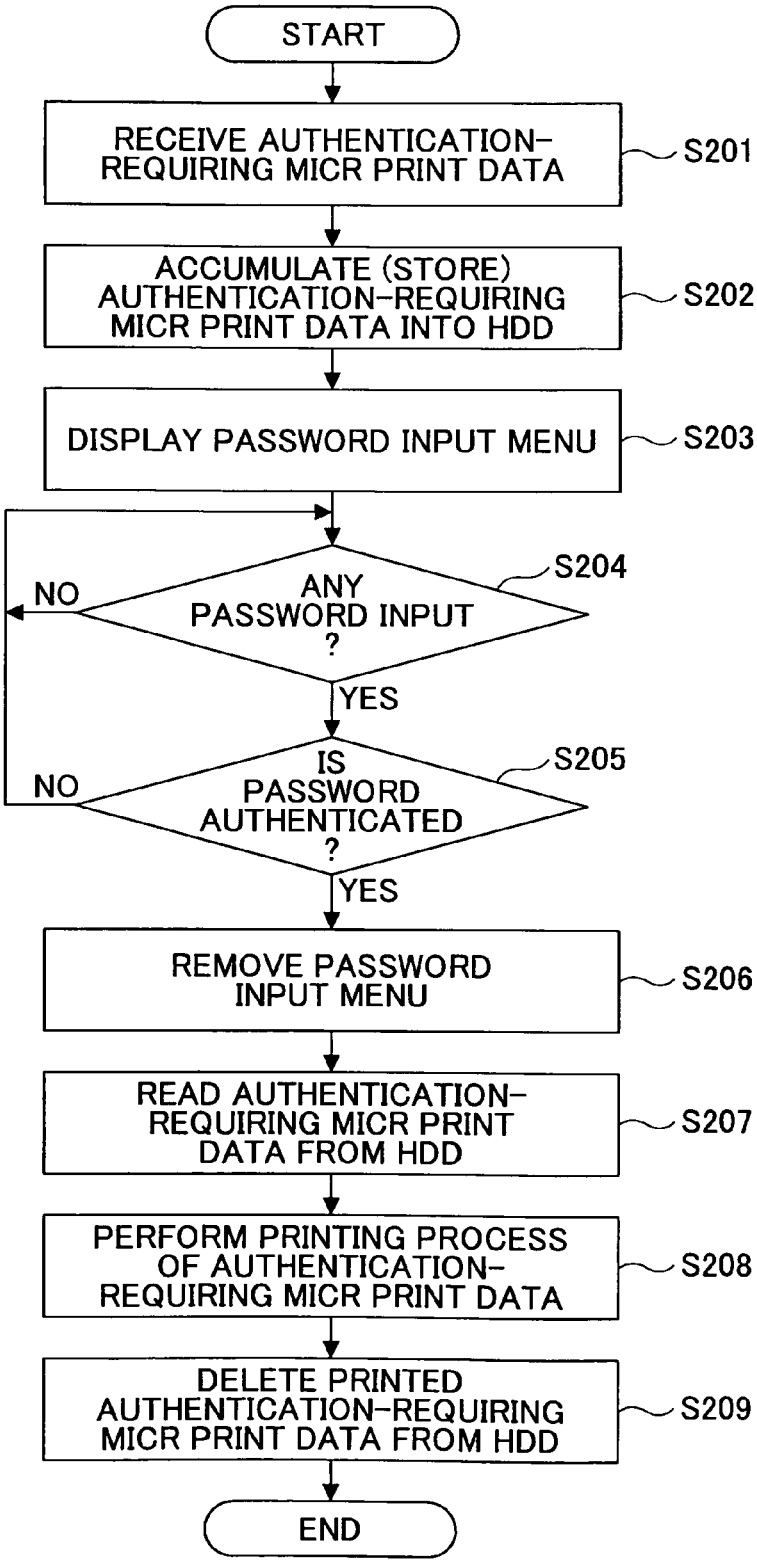
FIG. 10 is a flowchart showing an image forming control process of printing the authentication-requiring MICR print data, the process including a password authentication process.

Further, as shown in FIG. 10, with respect to the authentication-requiring MICR print data, the laser printer 1 may verify the authentication of the password before performing the printing process. Namely, as shown in the flowchart of FIG. 10, an image forming control process includes the authentication process of the password for allowing forming an image of the authentication-requiring MICR print data. As shown in the image forming control process shown in FIG. 10, in step S201, the communication control section 101 receives the authentication-requiring MICR print data from the host system HS. In step S202, the print data interpretation section 110 temporarily accumulates the authentication-requiring MICR print data into the HDD 15 via the data accumulation process control section 112. In step S203, after waiting until an instruction to perform the printing process is issued due to, for example, the fact that the predetermined timeout time has elapsed, the print data interpretation section 110 causes the operations panel control section 106 to display the password input menu on the display of the operations panel 3. In step S204, it is determined whether the password is input.

When it is determined that the password is input in step S204, the process goes to step S205. In step S205, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S204 to wait for the next password input. On the other hand, in the same step (step S205), when it is determined that there is consistency between the password stored in advance in the NVRAM 18 and the password input via the operations panel 3 (i.e., those passwords are the same), the process goes to step S206. In step S206, the password input menu is removed from the display of the operations panel 3.

After the print data interpretation section 110 removes the password input menu from the display of the operations panel 3, the process goes to step S207. In step S207, the print data interpretation section 110 reads the authentication-requiring MICR print data stored in the HDD 15 via the data accumulation process control section 112. In step S208, when necessary, the print data edit process section 115 edits the authentication-requiring MICR print data, and the edited authentication-requiring MICR print data are transmitted to the print data drawing section 103, or when no editing is required, the print data drawing section 103 are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the printing process.

In step S209, after the authentication-requiring MICR print data are printed, the print data interpretation section 110 removes the printed authentication-requiring MICR print data from the HDD 15 via the data accumulation process control section 112 to end the process.

As described above, in the laser printer 1 according to this embodiment of the present invention, the password input is requested by displaying the password input menu on the display of the operations panel 3 at a predetermined timing. The password control section 113 verifies the consistency between the password stored in advance in the NVRAM 18 and the password input via the operations panel 3. When the password input via the operations panel 3 is successfully authenticated, an image forming process of forming an image of the print data is allowed to be performed. As a result, the print data interpretation section 110 reads the authentication-requiring MICR print data stored in the HDD 15 and causes the printer engine 4 to form the image of the authentication-requiring MICR print data.

Therefore, in a case where authentication-requiring MICR print data are received, it may become possible to print the authentication-requiring MICR print data only when the password is successfully authenticated. As a result, it may become possible to protect confidentiality of the authentication-requiring MICR print data while improving the usability of the laser printer 1.

In the laser printer 1 according to the embodiment of the present invention described above, when receiving the authentication-requiring MICR print data, the authentication-requiring MICR print data are temporarily stored in the HDD 15, and the password authentication process is performed at a determined timing. When the password is successfully authenticated, the authentication-requiring MICR print data are allowed to be printed.

Figure 11:
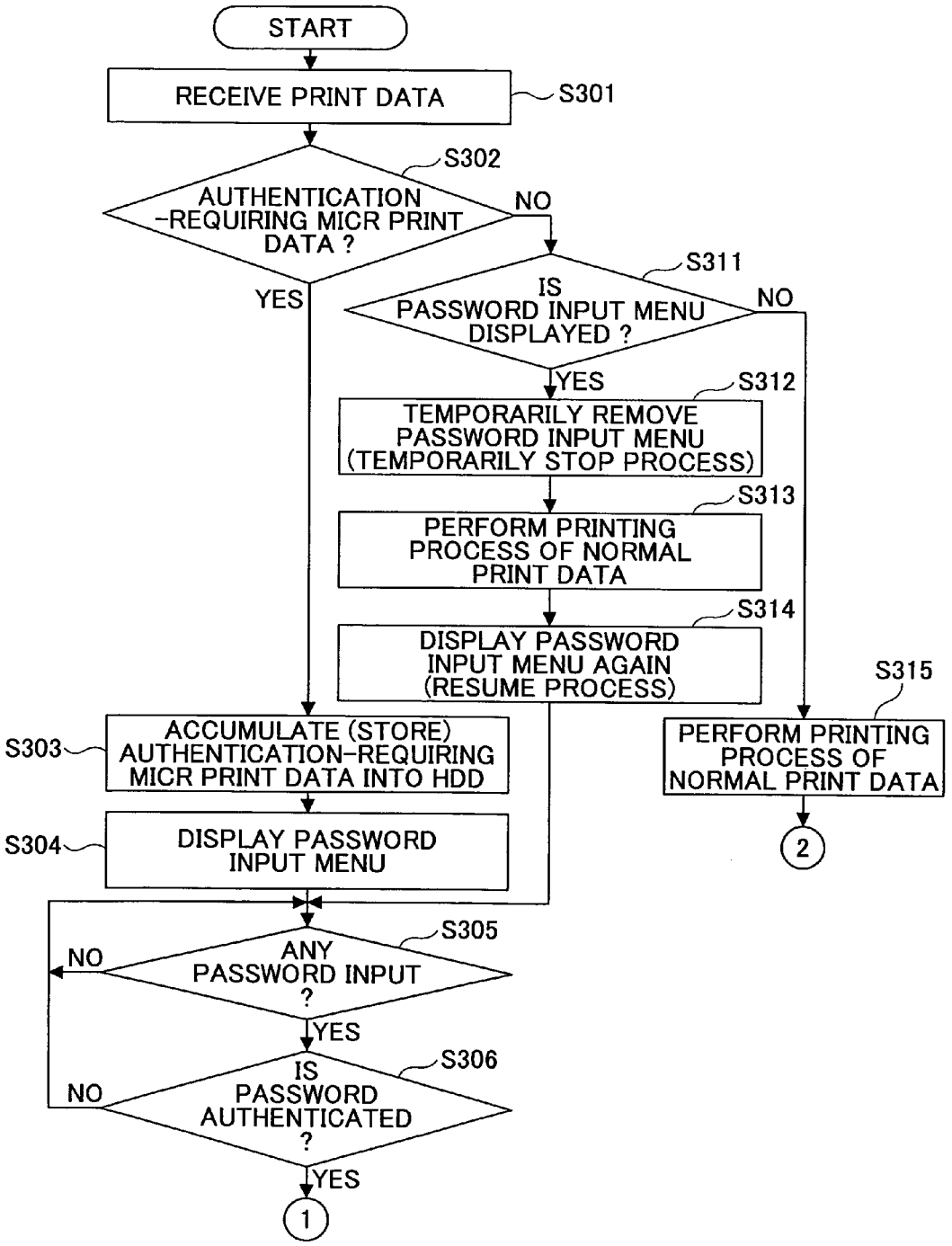
FIGS. 11 and 12 collectively show a flowchart showing an image forming control process of printing the authentication-requiring MICR print data, the process including a process of adjusting the priority of printing order.
Figure 12:
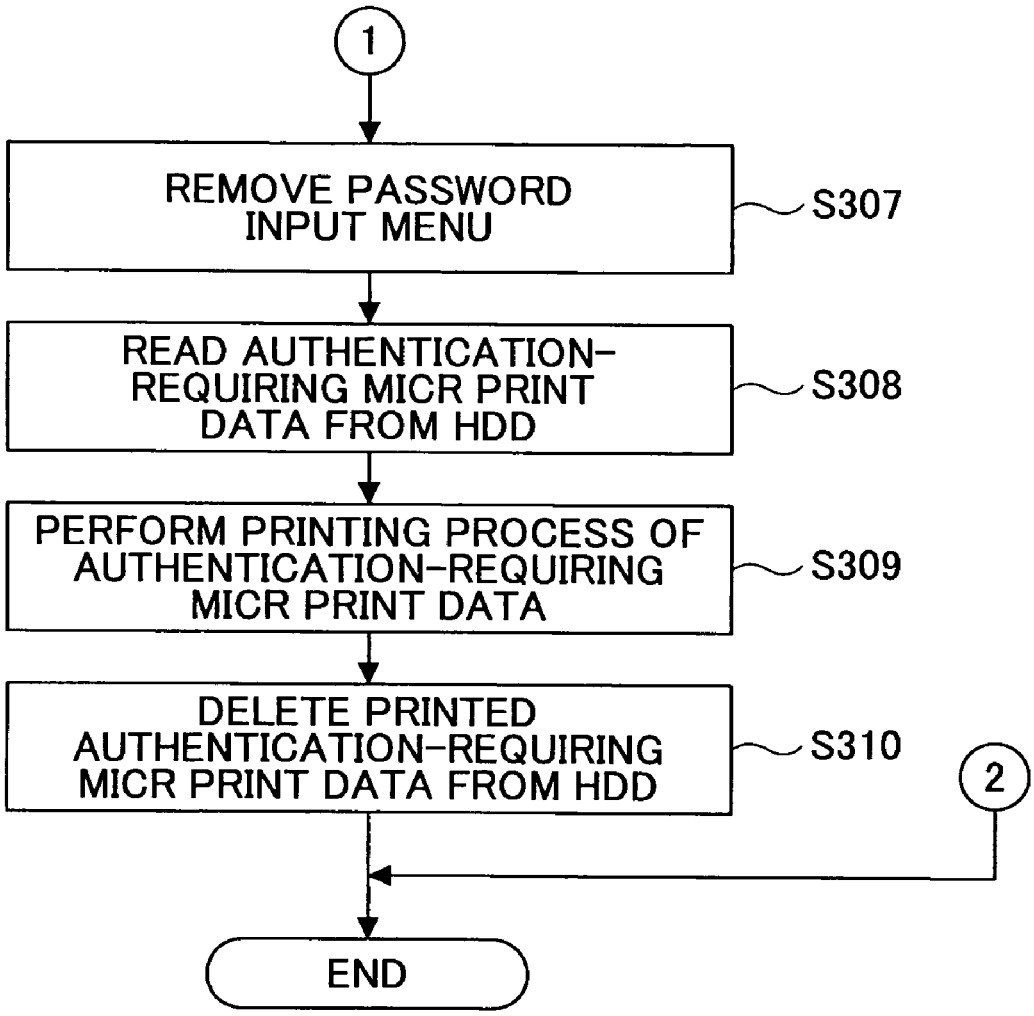

Next, another case is further considered where print data other than the authentication-requiring MICR print data (i.e., the normal MICR print data or the normal print data) are received before the password authentication process is successfully completed. In this case, as shown in FIGS. 11 and 12, the password authentication process is temporarily stopped (pauses) and the normal MICR print data or the normal print data that have been received later are printed with priority. In this case, it is assumed that the MICR-printing process cartridge is provided (inserted) as the MICR-printing process cartridge in the laser printer 1. Therefore, the image forming control process described below is applied to the normal MICR print data.

As shown in the image forming control process of FIG. 11, in step S301, the laser printer 1 receives the print data from the host system HS. In step S302, the print data interpretation section 110 determines whether the print data are the authentication-requiring MICR print data or the normal MICR print data. When it is determined that the print data are the authentication-requiring MICR print data, the process goes to step S303. In step S303, the data accumulation process control section 112 temporarily accumulates the authentication-requiring MICR print data in the HDD 15. In step S304, the operations panel control section 106 displays the password input menu on the display of the operations panel 3 at a predetermined timing. In step S305, it is determined whether the password is input. As the timing when the password input menu is displayed, a timing when the accumulation of the authentication-requiring MICR print data is started, a timing when the accumulation of the authentication-requiring MICR print data is completed, a time when a predetermined time is elapsed after the accumulation process is completed or the like may be adaptively used.

When, in step S305, it is determined that the password is input by, for example, the key operations on the operations panel 3, the process goes to step S306. In step S306, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, the process goes back to step S305 to wait for next password input. On the other hand, in the same step (step S306), when it is determined that there is consistency between the password stored in advance in the NVRAM 18 and the password input via the operations panel 3 (i.e., those passwords are the same), the process goes to step S307. In step S307, as shown in FIG. 12, the password input menu is removed from the display of the operations panel 3.

When the password input menu is removed from the display of the operations panel 3, the process goes to step S308. In step S308, the print data interpretation section 110 reads the authentication-requiring MICR print data stored in the HDD 15 from the HDD 15 via the data accumulation process control section 112. In step S309, when necessary, the print data edit process section 115 edits the authentication-requiring MICR print data, and the edited authentication-requiring MICR print data are transmitted to the print data drawing section 103, or when no editing is required, the authentication-requiring MICR print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the printing process.

In step S310, after the authentication-requiring MICR print data are printed, the print data interpretation section 110 removes the printed authentication-requiring MICR print data from the HDD 15 via the data accumulation process control section 112 to end the process.

In step S302 of FIG. 11, when it is determined that the print data are not the authentication-requiring MICR print data, (i.e., it is determined that the print data are the normal MICR print data), the process goes to step S311. In step S311, the print data interpretation section 110 determines whether the password input menu is being displayed, the password input menu corresponding to the authentication-requiring MICR print data that have been received and accumulated in the HDD 15. When it is determined that the password input menu is being displayed, the process goes to step S312. In step S312, the password input menu is temporarily removed (the password authentication process is temporarily stopped) from the display of the operations panel 3. In step S313, the normal MICR print data are printed. In this printing process, as described above, a necessary editing process of the print data is performed, and the print data drawing section 103 converts the edited print data (normal MICR print data) into drawing data and transmits the converted drawing data to the printer engine 4 via the print control section 104 so that the print control section 104 performs the printing process.

After the normal MICR print data are printed, the process goes to step S314. In step S314, the print data interpretation section 110 causes the operations panel control section 106 to display again the password input menu that has been temporarily removed from the display of the operations panel 3. Then, the process goes to step S305 where it is determined whether the password is input.

When it is determined that the password is input in step S305, the process goes to step S306. In step S306, the password control section 113 verifies the consistency between the password stored in advance in the NVRAM 18 and the password input via the operations panel 3 and determines whether there is the consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S305 to wait for the next password input. On the other hand, in the same step (step S306), when it is determined that there is consistency between the password stored in advance in the NVRAM 18 and the password input via the operations panel 3 (i.e., those passwords are the same), the process goes to step S307. In step S307 shown in FIG. 12, the password input menu is removed from the display of the operations panel 3. After the print data interpretation section 110 removes the password input menu from the display of the operations panel 3, the process goes to step S308. In step S308, the print data interpretation section 110 reads the authentication-requiring MICR print data stored in the HDD 15 via the data accumulation process control section 112. In step S309, when necessary, the print data edit process section 115 edits the authentication-requiring MICR print data, and the edited authentication-requiring MICR print data are transmitted to the print data drawing section 103; or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the printing process.

In step S310, after the authentication-requiring MICR print data are printed, the print data interpretation section 110 removes the printed authentication-requiring MICR print data from the HDD 15 via the data accumulation process control section 112 to end the process.

In step S311, when the print data interpretation section 110 determines that the password input menu is not being displayed, the process goes to step S315. In step S315, when necessary, the print data edit process section 115 edits the received normal MICR print data, and the edited normal MICR print data are transmitted to the print data drawing section 103; or when no editing is required, the print data are directly transmitted to the print data drawing section 103. Further, in the same step, the print data drawing section 103 converts the normal MICR print data into drawing data, and transmits the converted drawing data to the printer engine 4 via the print control section 104 so that the print control section 104 performs the printing process of (prints) the image of the normal MICR print data, and the process ends.

As described above, in the laser printer 1 according to this embodiment of the present invention, when the normal MICR print data are received while the password input menu is being displayed on the display of the operations panel 3 to request password input, the password input request is temporarily stopped and the image of the normal MICR print data are formed (i.e., the received normal MICR print data are printed) by the printer engine 4.

Therefore, when it takes time to input the password, it may become possible to perform an image forming process of (printing) the normal MICR print data, for which it is not required to perform the password authentication process, prior to printing the authentication-requiring MICR print data, thereby further improving the usability of the laser printer 1 while protecting confidentiality of the authentication-requiring MICR print data.

Third Embodiment

Figure 13:
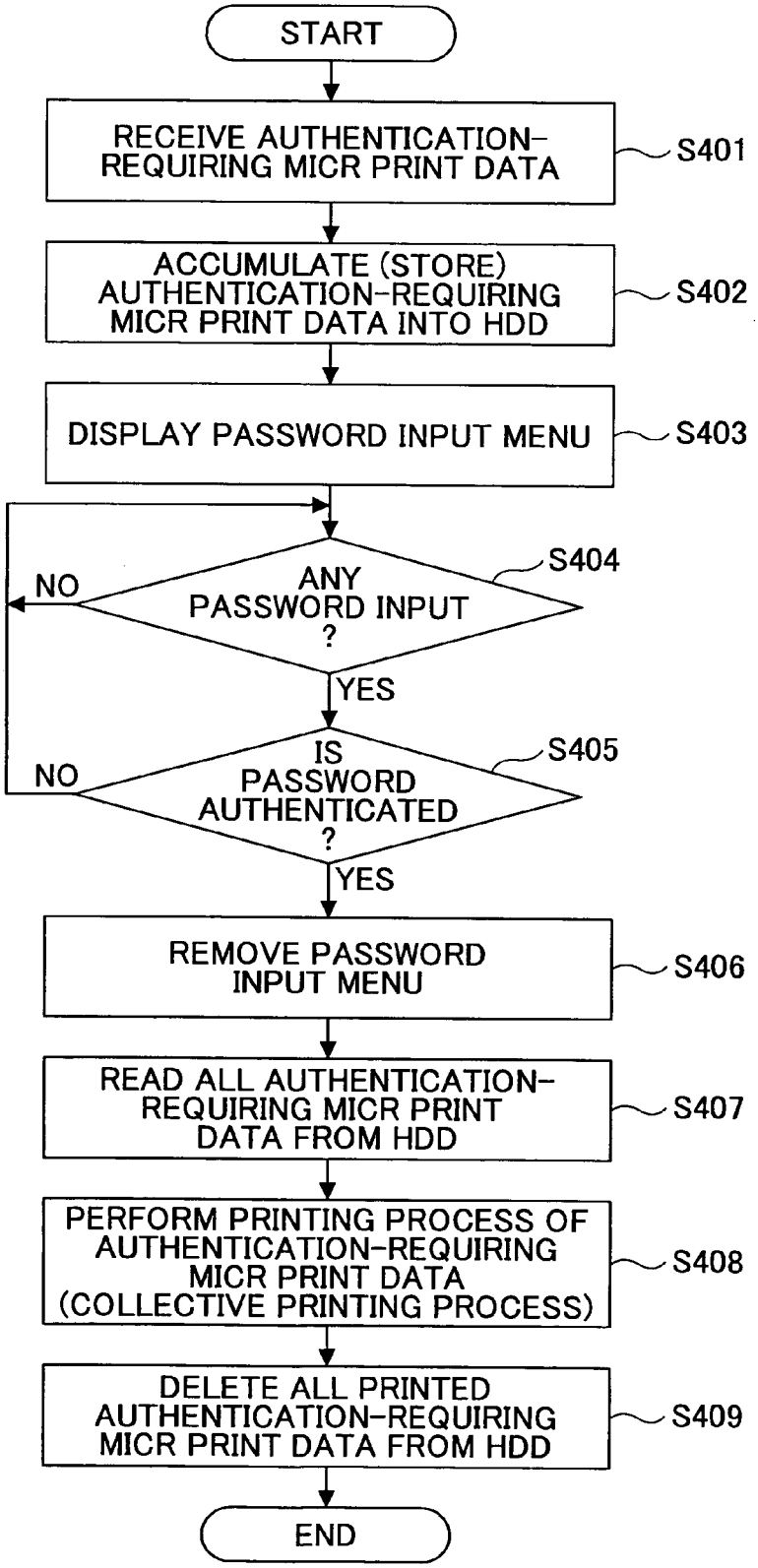
FIG. 13 is a flowchart showing an image forming control process of performing a collective printing of the authentication-requiring MICR print data.
Figure 14:
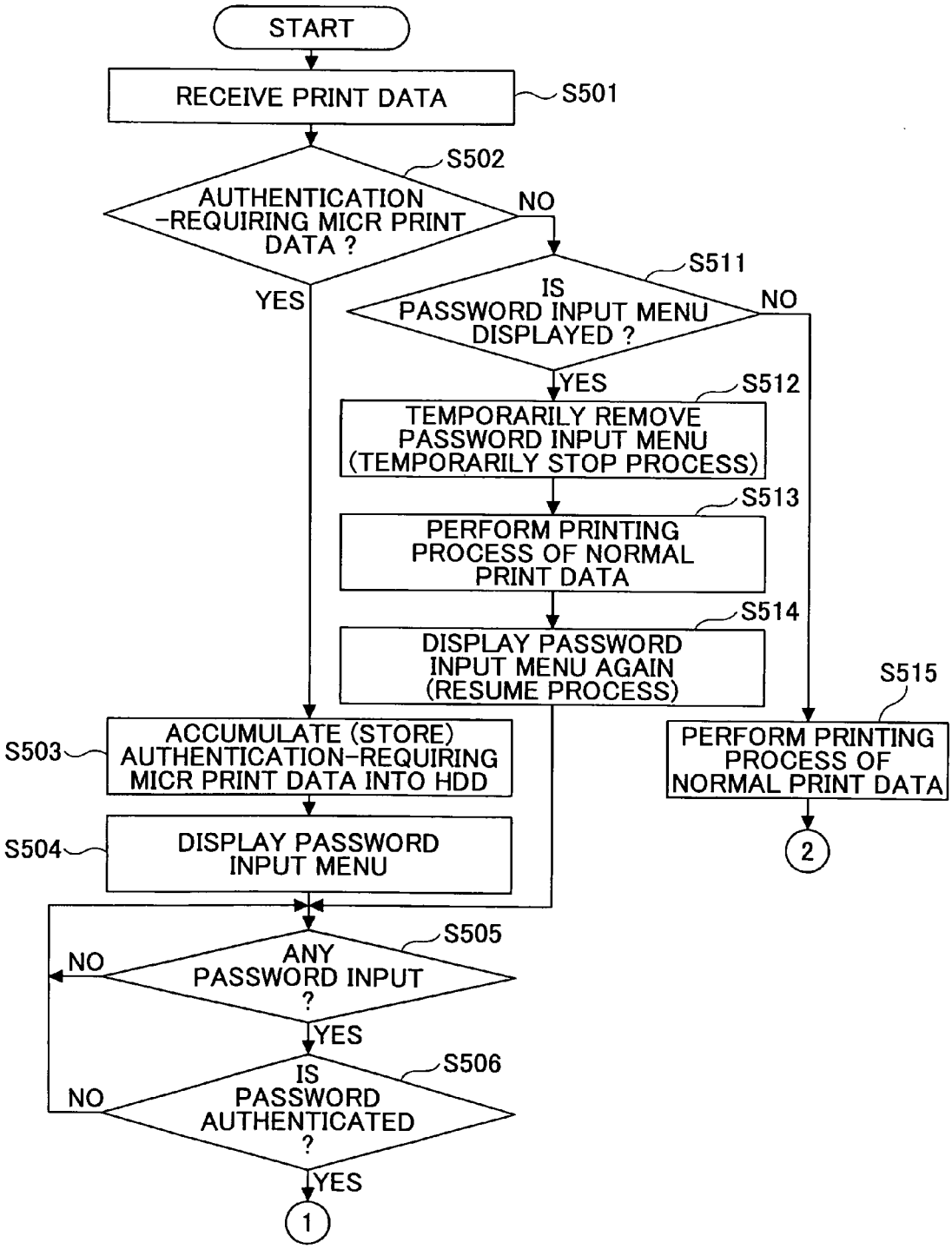
FIGS. 14 and 15 collectively show a flowchart showing an image forming control process of printing the authentication-requiring MICR print data, the process including a process of adjusting the priority of the printing order.
Figure 15:
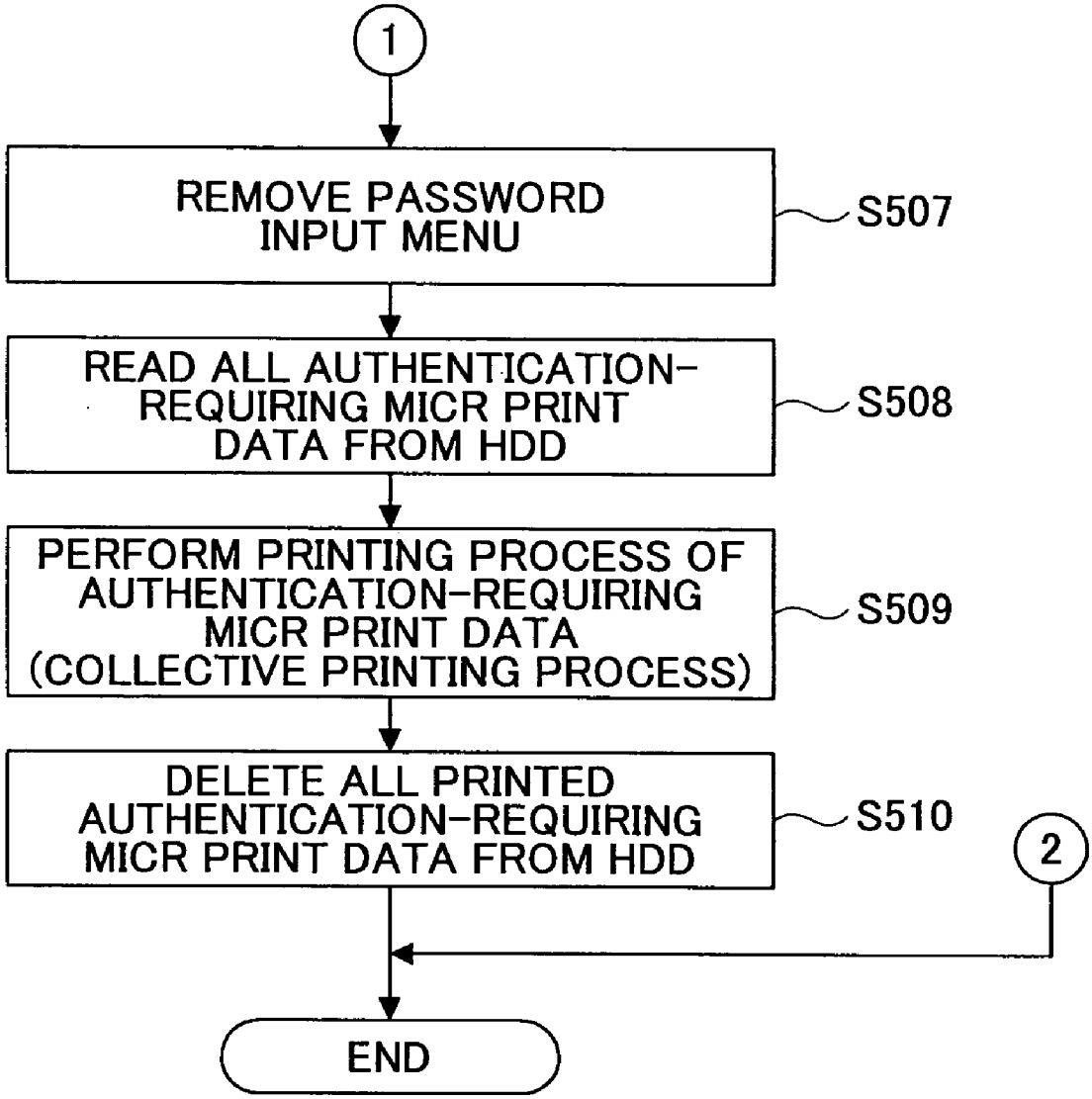

FIGS. 13 through 15 are flowcharts showing an image forming control process that may achieve an image forming apparatus, an image forming control method, an image forming control program and a recording medium according to a third embodiment of the present invention. FIG. 13 is a flowchart showing an image forming control process of forming an image of the authentication-requiring MICR print data in a laser printer 1, the image forming control process being capable of being applied to the an image forming apparatus, the image forming control method, the image forming control program and the recording medium according to the third embodiment of the present invention.

This third embodiment is similarly applied to the laser printer 1 according to the second embodiment of the present invention, and the same reference numerals may be used in the figures for the same or equivalent elements shown in the second embodiment of the present invention.

In this embodiment of the present invention, when plural authentication-requiring MICR print data are accumulated in the HDD 15, the plural authentication-requiring MICR print data relevant to the password that has been successfully authenticated are collectively printed.

Namely, as shown in the image forming control process in FIG. 13, in step S401, the laser printer 1 receives the authentication-requiring MICR print data. In step S402, the print data interpretation section 110 temporarily accumulates the authentication-requiring MICR print data into the HDD 15 via the data accumulation process control section 112. In step S403, the print data interpretation section 110 waits until an instruction to perform the printing process is issued due to, for example, the fact that the predetermined timeout time has elapsed. In this waiting time, if another of the authentication-requiring MICR print data are received, the authentication-requiring MICR print data are sequentially accumulated in the HDD 15 in the same manner as described above. When the time comes to start the printing process due to, for example, the fact that the predetermined timeout time has elapsed, the print data interpretation section 110 causes the operations panel control section 106 to display the password input menu on the display of the operations panel 3. In step S404, it is determined whether the password is input.

When it is determined that the password is input by, for example, the key operations of the operations panel 3 in step S404, the process goes to step S405. In step S405, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S404 to wait for the next password input. On the other hand, in the same step (step S405), when it is determined that there is consistency between the password stored in advance in the NVRAM 18 and the password input via the operations panel 3 (i.e., those passwords are the same), the process goes to step S406. In step S406, the password input menu is removed from the display of the operations panel 3.

After the print data interpretation section 110 removes the password input menu from the display of the operations panel 3, the process goes to step S407. In step S407, the print data interpretation section 110 reads all the authentication-requiring MICR print data that are relevant to the password and that are stored in the HDD 15 via the data accumulation process control section 112. In step S408, when necessary, the print data edit process section 115 sequentially edits each of the authentication-requiring MICR print data, and the edited authentication-requiring MICR print data are transmitted to the print data drawing section 103, or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs a collective printing process.

In step S409, after the authentication-requiring MICR print data are collectively printed, the print data interpretation section 110 removes all the printed authentication-requiring MICR print data from the HDD 15 via the data accumulation process control section 112 to end the process.

As described above, in the laser printer 1 according to this embodiment of the present invention, when the password is successfully authenticated and the image forming process is allowed to be started, if in the HDD 15, there are plural authentication-requiring MICR print data relevant to the same password that has been authenticated, all the plural authentication-requiring MICR print data are read and collectively printed by the printer engine 4.

Therefore, when plural authentication-requiring MICR print data are accumulated in the HDD 15 and some of plural authentication-requiring MICR print data have the same password, it may become possible to perform the password authentication at once so that the plural authentication-requiring MICR print data having the same password can be collectively read and printed by a single password authentication process. In other words, it is not necessary to perform the password authentication process for each of the authentication-requiring MICR print data having the same password. As a result, it may become possible to further improve the usability of the laser printer 1.

In the above description of the laser printer 1, when the authentication-requiring MICR print data are received, the authentication-requiring MICR print data are temporarily accumulated. Then, the password authentication process is performed at a predetermined timing. When the password is successfully authenticated, all the authentication-requiring MICR print data that can be printed using the same password are collectively printed. Next, another case is considered where the normal MICR print data as the print data other than the authentication-requiring MICR print data are received before the password authentication process is completed. In this case, as shown in FIGS. 14 and 15, the password authentication process is temporarily stopped and the normal MICR print data received after the authentication-requiring MICR print data are printed first. Then after the normal MICR print data are printed, the authentication-requiring MICR print data are collectively printed.

Namely, as shown in the image forming control process for the authentication-requiring MICR print data of FIG. 14, in step S501, the laser printer 1 receives the print data from the host system HS. In step S502, the print data interpretation section 110 determines whether the print data are the authentication-requiring MICR print data or the normal MICR print data. When it is determined that the print data are the authentication-requiring MICR print data, the process goes to step S503. In step S503, the data accumulation process control section 112 temporarily accumulates the authentication-requiring MICR print data in the HDD 15. In step S504, the operations panel control section 106 displays the password input menu on the display of the operations panel 3 at a predetermined timing. In step S505, it is determined whether the password is input.

When, in step S505, it is determined that the password is input by, for example, the key operations on the operations panel 3, the process goes to step S506. In step S506, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S505 to wait for the next password input. On the other hand, in the same step (step S506), when it is determined that there is consistency between the password stored in advance in the NVRAM 18 and the password input via the operations panel 3 (i.e., those passwords are the same), the process goes to step S507. In step S507, as shown in FIG. 15, the password input menu is removed from the display of the operations panel 3.

When the password input menu is removed from the display of the operations panel 3, the process goes to step S508. In step S508, the print data interpretation section 110 reads all the authentication-requiring MICR print data that are relevant to the same password and that are stored in the HDD 15 from the HDD 15 via the data accumulation process control section 112. In step S509, when necessary, the print data edit process section 115 edits the read authentication-requiring MICR print data, and the edited authentication-requiring MICR print data are transmitted to the print data drawing section 103; or when no editing is required, the authentication-requiring MICR print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the collective printing process of (collectively prints) the images of the authentication-requiring MICR print data.

In step S510, after the authentication-requiring MICR print data are printed, the print data interpretation section 110 removes the printed authentication-requiring MICR print data from the HDD 15 via the data accumulation process control section 112 to end the process.

In step S502 of FIG. 14, when it is determined that the print data are the normal MICR print data that do not require performing the password authentication process, the process goes to step S511. In step S511, the print data interpretation section 110 determines whether the password input menu is being displayed, the password input menu corresponding to the authentication-requiring MICR print data that have been received and accumulated in the HDD 15. When it is determined that the password input menu is being displayed, the process goes to step S512. In step S512, the password input menu is temporarily removed (the password authentication process is temporarily stopped) from the display of the operations panel 3. In step S513, the normal MICR print data are printed. In this printing process, as described above, a necessary editing process of the print data is performed, and the print data drawing section 103 converts the edited print data (normal MICR print data) into drawing data and transmits the converted drawing data to the printer engine 4 via the print control section 104 so that the print control section 104 performs the printing process on a sheet.

After the normal MICR print data are printed, the process goes to step S514. In step S514, the print data interpretation section 110 causes the operations panel control section 106 to display again the password input menu that has been temporarily removed from the display of the operations panel 3. Then, the process goes to step S505 where it is determined whether the password is input.

When it is determined that the password is input in step S505, the process goes to step S506. In step S506, the password control section 113 verifies the consistency between the password stored in advance in the NVRAM 18 and the password input via the operations panel 3 and determines whether there is the consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S505 to wait for next password input. On the other hand, in the same step (step S506), when it is determined that there is consistency between the password stored in advance in the NVRAM 18 and the password input via the operations panel 3 (i.e., those passwords are the same), the process goes to step S507. In step S507 shown in FIG. 15, the password input menu is removed from the display of the operations panel 3. After the print data interpretation section 110 removes the password input menu from the display of the operations panel 3, the process goes to step S508. In step S508, the print data interpretation section 110 reads all the authentication-requiring MICR print data that are relevant to the same password and that are stored in the HDD 15 via the data accumulation process control section 112. In step S509, when necessary, the print data edit process section 115 edits the authentication-requiring MICR print data, and the edited authentication-requiring MICR print data are transmitted to the print data drawing section 103; or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the collective printing process of (collectively prints) the images of the authentication-requiring MICR print data.

In step S510, after the authentication-requiring MICR print data are printed, the print data interpretation section 110 removes the printed authentication-requiring MICR print data from the HDD 15 via the data accumulation process control section 112 to end the process.

In step S511, when the print data interpretation section 110 determines that the password input menu is not being displayed, the process goes to step S515. In step S515, when necessary, the print data edit process section 115 edits the received normal MICR print data, and the edited normal MICR print data are transmitted to the print data drawing section 103; or when no editing is required, the print data are directly transmitted to the print data drawing section 103. Further, in the same step, the print data drawing section 103 converts the normal MICR print data into drawing data, and transmits the converted drawing data to the printer engine 4 via the print control section 104 so that the print control section 104 performs the printing process of (prints) the image of the normal MICR print data, and the process ends.

As described above, in the laser printer 1 according to this embodiment of the present invention, when the normal MICR print data are input while the password input is requested by displaying the password input menu, the request of password input is temporarily stopped and the normal MICR print data are printed with priority by the printer engine 4.

Therefore, when the normal MICR print data are received while the password input menu is displayed to perform an image forming control process to collectively print plural authentication-requiring MICR print data or a large-capacity authentication-requiring MICR print data, it may become possible to print with priority the normal MICR print data. As a result, the received normal MICR print data may be processed to be printed first without waiting for the input of the password and a time period from when the password is input and authenticated to when the print of the authentication-requiring MICR print data is completed, thereby enabling further improving the usability of the laser printer 1.

Fourth Embodiment

Figure 16:
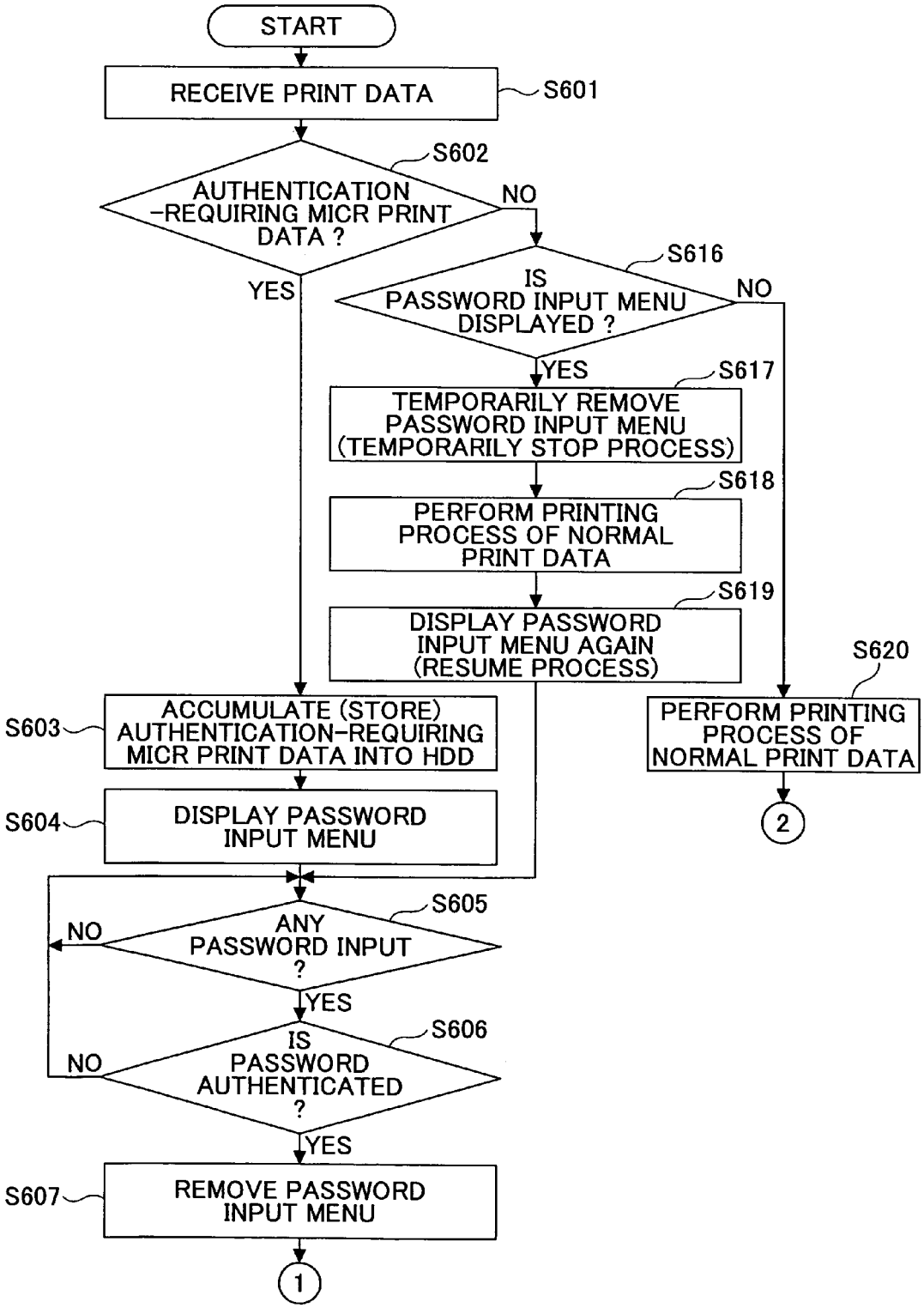
FIGS. 16 and 17 collectively show a flowchart showing an image forming control process of printing the authentication-requiring MICR print data, the process including a process of controlling the accumulation of the authentication-requiring MICR print data.
Figure 17:
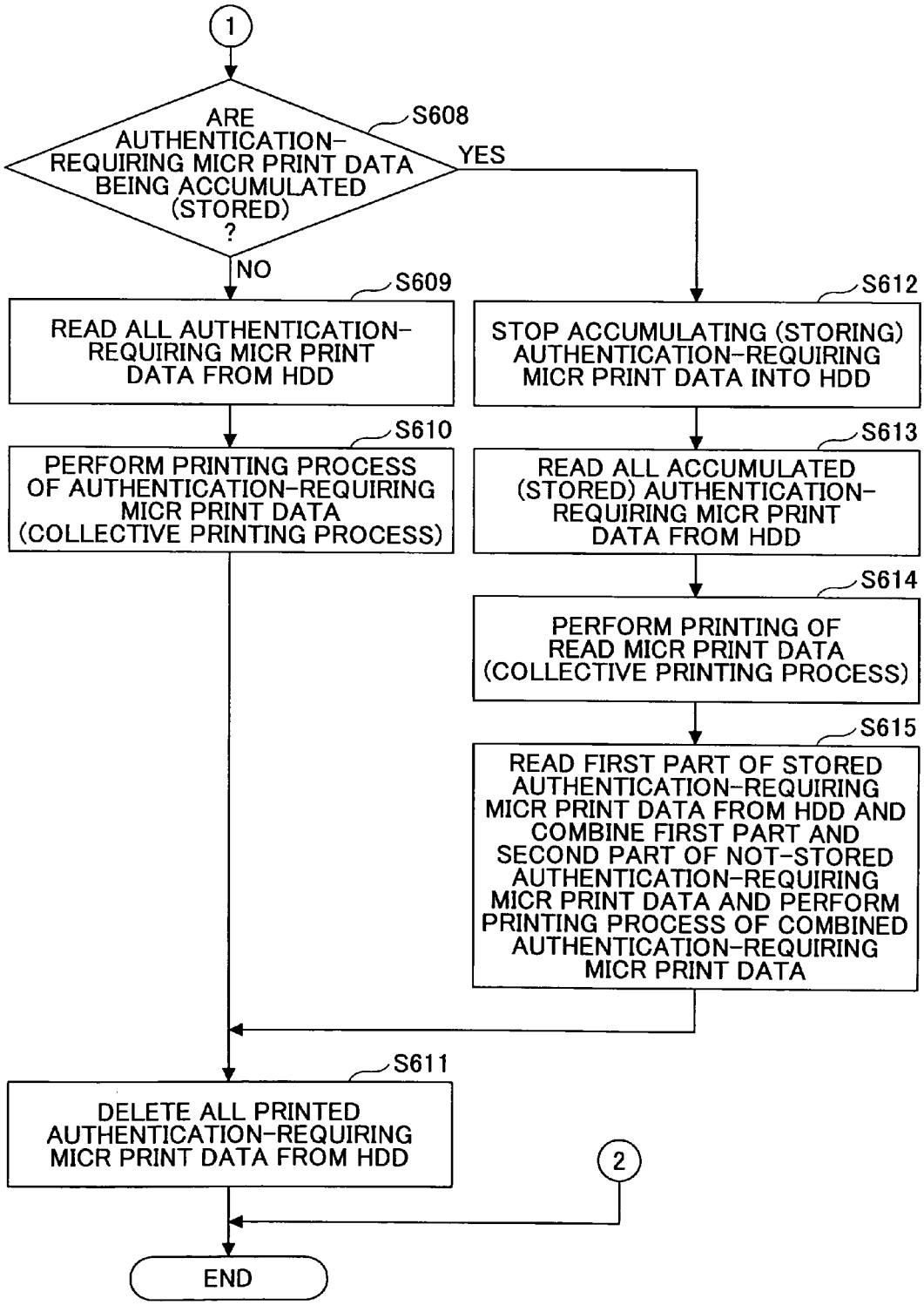

FIGS. 16 and 17 are flowcharts showing an image forming control process that may achieve an image forming apparatus, an image forming control method, an image forming control program and a recording medium according to a fourth embodiment of the present invention. FIG. 16 is a flowchart showing an image forming control process including an accumulation control process of the authentication-requiring MICR print data in a laser printer 1, the image forming control process being capable of being applied to the image forming apparatus, the image forming control method, the image forming control program and the recording medium according to the fourth embodiment of the present invention.

This forth embodiment may be similarly applied to the laser printer 1 according to the second embodiment of the present invention, and the same reference numerals may be used in the figures for the same or equivalent elements in the second embodiment of the present invention.

In the embodiment of the present invention, if the accumulation process of the authentication-requiring MICR print data into the HDD 15 is still being performed when the password authentication process is completed, the accumulation process of the authentication-requiring MICR print data into the HDD 15 is stopped and the authentication-requiring MICR print data that have been accumulated into the HDD 15 and the authentication-requiring MICR print data that have not been accumulated into the HDD 15 are combined and collectively printed.

Namely, as shown in the flowchart of FIG. 16, in step S601, the laser printer 1 receives the print data from the host system HS. In step S602, the print data interpretation section 110 determines whether the print data are the authentication-requiring MICR print data or the normal MICR print data. When it is determined that the print data are the authentication-requiring MICR print data, the process goes to step S603. In step S603, the data accumulation process control section 112 temporarily accumulates the authentication-requiring MICR print data in the HDD 15. In step S604, the operations panel control section 106 displays the password input menu on the display of the operations panel 3. In step S605, it is determined whether the password is input.

When, in step S605, it is determined that the password is input by, for example, the key operations on the operations panel 3, the process goes to step S606. In step S606, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S605 to wait for the next password input. On the other hand, in the same step (step S606), when it is determined that there is consistency between the password stored in advance in the NVRAM 18 and the password input via the operations panel 3 (i.e., those passwords are the same), the process goes to step S607. In step S607, as shown in FIG. 16, the password input menu is removed from the display of the operations panel 3.

When the password input menu is removed, the process goes to step S608. Referring to FIG. 17, in step S608, the print data interpretation section 110 determines whether the accumulation process of the authentication-requiring MICR print data is still being performed (i.e., whether the accumulation operation the accumulation process of the authentication-requiring MICR print data is not completed). When it is determined that the accumulation process of the authentication-requiring MICR print data is not being performed (i.e., the accumulation process is completed, NO in step S608), the process goes to step S609. In step S609, the print data interpretation section 110 causes the data accumulation process control section 112 to read all the authentication-requiring MICR print data that are relevant to the password and that are accumulated in the HDD 15. In step S610, when necessary, the print data edit process section 115 edits the authentication-requiring MICR print data, and the edited authentication-requiring MICR print data are transmitted to the print data drawing section 103; or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the collective printing process of (collectively prints) the image of the authentication-requiring MICR print data.

In step S611, after the authentication-requiring MICR print data are printed, the print data interpretation section 110 removes the printed authentication-requiring MICR print data from the HDD 15 via the data accumulation process control section 112 to end the process.

On the other hand, in step S608, when it is determined that the accumulation process of the authentication-requiring MICR print data is still being performed (i.e., the accumulation process is not completed, YES in step S608), the process goes to step S612. In step S612, the print data interpretation section 110 stops the process of accumulating the authentication-requiring MICR print data into the HDD 15. In step S613, all the authentication-requiring MICR print data that are relevant to the password and that have been already accumulated into the HDD 15 are read from the HDD 15. In step S614, when necessary, the print data edit process section 115 edits the authentication-requiring MICR print data, and the edited authentication-requiring MICR print data are transmitted to the print data drawing section 103; or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the collective printing process of (collectively prints) the image of the authentication-requiring MICR print data.

Next, with regard to the authentication-requiring MICR print data that have stopped to be accumulated into the HDD 15 in step S612, there are generated two parts of authentication-requiring MICR print data: a first part of the data that have already accumulated in the HDD 15 before step S612 is performed, and a second part of the data that have not accumulated in the HDD due to the accumulation stop in step S612. In step S615, the print data interpretation section 110 reads the first part of the authentication-requiring MICR print data from the HDD 15. Then, the print data interpretation section 110 combines the read first part of the authentication-requiring MICR print data and the second part of the authentication-requiring MICR print data. When necessary, the print data edit process section 115 edits the combined authentication-requiring MICR print data, and the edited combined authentication-requiring MICR print data are transmitted to the print data drawing section 103, or when no editing is required, the print data are directly transmitted to the print data drawing section 103. Further, in the same step, the print data drawing section 103 converts the combined authentication-requiring MICR print data into drawing data, and transmits the converted drawing data to the printer engine 4 via the print control section 104 so that the print control section 104 performs the collective printing process of (collectively prints) the image of the combined authentication-requiring MICR print data.

In step S611, after the authentication-requiring MICR print data are printed, the print data interpretation section 110 removes the printed authentication-requiring MICR print data from the HDD 15 via the data accumulation process control section 112 to end the process.

Further, in step S602 of FIG. 16, when it is determined that the print data are not the authentication-requiring MICR print data but the normal MICR print data that do not require performing the password authentication process, the process goes to step S616. In step S616, the print data interpretation section 110 determines whether the password input menu is being displayed, the password input menu corresponding to the authentication-requiring MICR print data that have been received and accumulated in the HDD 15. When it is determined that the password input menu is being displayed, the process goes to step S617. In step S617, the password input menu is temporarily removed (the password authentication process is temporarily stopped) from the display of the operations panel 3. In step S618, the normal MICR print data are printed.

After the normal MICR print data are printed, the process goes to step S619. In step S619, the print data interpretation section 110 causes the operations panel control section 106 to display again the password input menu that has been temporarily removed from the display of the operations panel 3. Then, the process goes to step S605 where it is determined whether the password is input to continue the process (steps S605 through S619).

In step S616, when the print data interpretation section 110 determines that the password input menu is not being displayed, the process goes to step S620. In step S620, when necessary, the print data edit process section 115 edits the received normal MICR print data, and the edited normal MICR print data are transmitted to the print data drawing section 103; or when no editing is required, the print data are directly transmitted to the print data drawing section 103. Further, in the same step, the print data drawing section 103 converts the normal MICR print data into drawing data, and transmits the converted drawing data to the printer engine 4 via the print control section 104 so that the print control section 104 performs the printing process of (prints) the image of the normal MICR print data, and the process ends.

As described above, in the laser printer 1 according to this embodiment of the present invention, if the password authentication process is completed after the accumulation process of the received authentication-requiring MICR print data is started and in the middle of the accumulation process, the accumulation process of the received authentication-requiring MICR print data which are being processed is stopped and the authentication-requiring MICR print data that are relevant to the password and that have been accumulated in the HDD 15 are read and printed. Further, in the authentication-requiring MICR print data that are not completely accumulated into the HDD 15 because of the stopped accumulation process, the part of authentication-requiring MICR print data that has already accumulated into the HDD 15 and the part of the authentication-requiring MICR print data that has not accumulated into the HDD 15 are combined and collectively printed.

Therefore, for example, while plural authentication-requiring MICR print data are consecutively received or while a large amount of the authentication-requiring MICR print data is received and if the password authentication process relevant to the authentication-requiring MICR print data is completed in the middle of accumulating the authentication-requiring MICR print data into the HDD 15, the authentication-requiring MICR print data that are relevant to the password and that have been already accumulated into the HDD 15 may be printed with priority, thereby enabling improving the usability of the laser printer 1.

Fifth Embodiment

Figure 18:
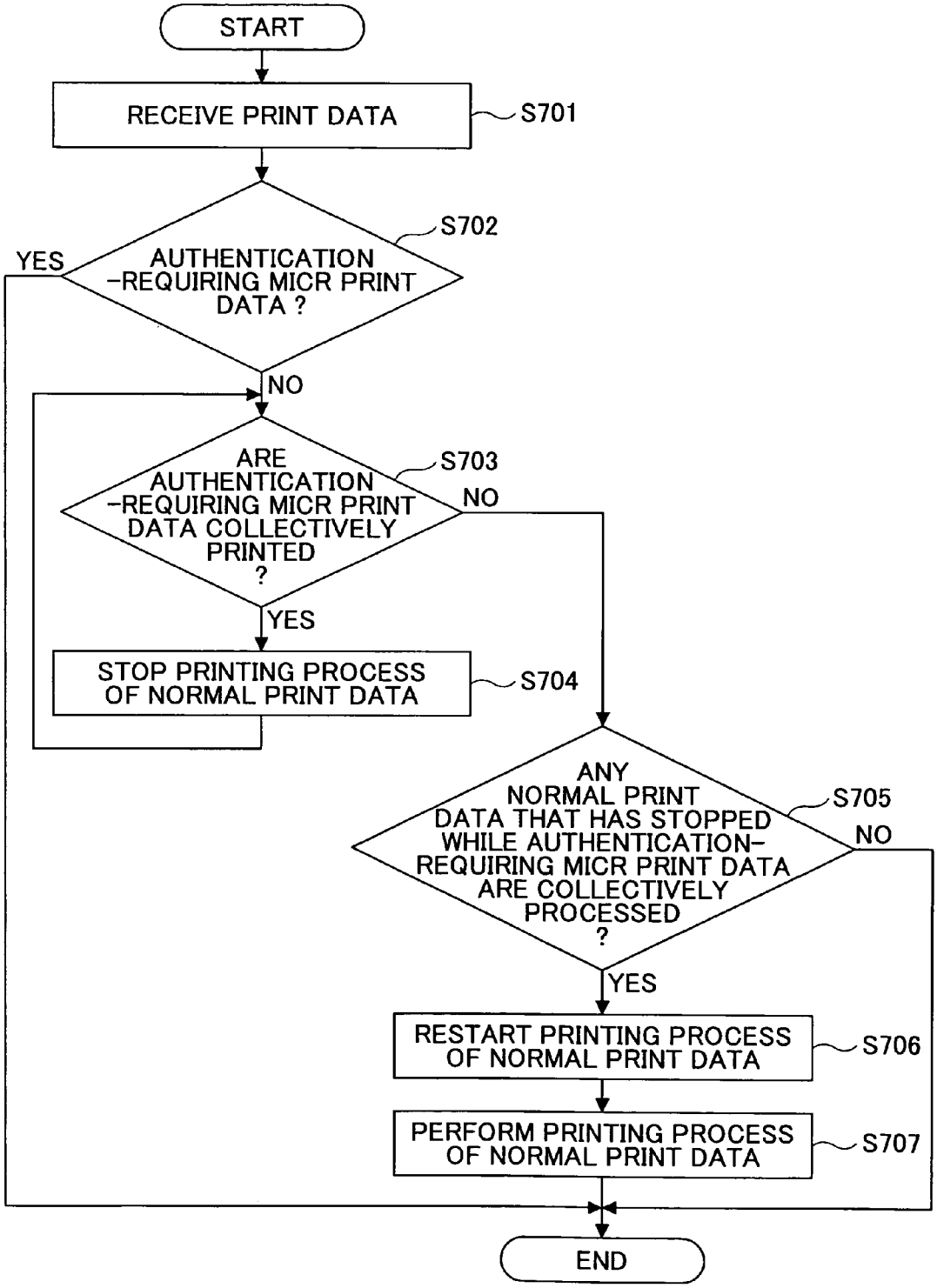
FIG. 18 is a flowchart showing a collective image forming control process of printing the authentication-requiring MICR print data.

FIG. 18 is flowchart showing an image forming control process that may achieve an image forming apparatus, an image forming control method, an image forming control program and a recording medium according to a fifth embodiment of the present invention.

This fifth embodiment is similarly applied to the laser printer 1 according to the second embodiment of the present invention, and the same reference numerals may be used in the figures for the same or equivalent elements in the second embodiment of the present invention.

According to this embodiment of the present invention, while plural authentication-requiring MICR print data accumulated in the HDD 15 are being printed, when the normal MICR print data are received, the printing process of the normal MICR print data is arranged to be performed after the printing process of the plural authentication-requiring MICR print data is completed.

Namely, as shown in the flowchart of FIG. 18, in step S701, the laser printer 1 receives the print data. In step S702, the print data interpretation section 110 determines whether the print data are the authentication-requiring MICR print data. When it is determined that the print data are the authentication-requiring MICR print data, any of the processes described above may be performed with respect to the received authentication-requiring MICR print data. In the case, according to the flowchart of FIG. 18, the process goes to the end of this process. However, actually, some processes are performed including a process of accumulating the received authentication-requiring MICR print data into the HDD 15.

When, in step 702, it is determined that the print data are not the authentication-requiring MICR print data, the process goes to step S703. In step S703, the print data drawing section 103 determines whether plural authentication-requiring MICR print data accumulated in the HDD 15 are being collectively printed. When it is determined that the plural authentication-requiring MICR print data are being collectively printed, the process goes to step S704. In step S704, the printing process of printing the received normal MICR print data (in the figure, may be referred to as normal print data) is temporarily stopped, and the collective printing of the authentication-requiring MICR print data is continued. Then the process goes back to step S703 to determine whether the collective printing of the authentication-requiring MICR print data is completed or the printing is still being performed.

When, in step S703, it is determined that the collective printing of the authentication-requiring MICR print data is completed (NO in step S703), the process goes to step S705. In step S705, the print data drawing section 103 determines whether there are any printing process of printing the normal MICR print data that has been temporarily stopped while the collective printing of the authentication-requiring MICR print data is being performed. When it is determined that there is no normal MICR print data printing process that has been stopped while the collective printing of the authentication-requiring MICR print data is being performed, the process directly ends.

On the other hand, when, in step S705, it is determined that the there is a normal MICR print data printing process that has been stopped while the collective printing of the authentication-requiring MICR print data is being performed, the process goes to step S706. In step S706, the printing process that has stopped is resumed. In step S707, when the printing process of printing the normal MICR print data is completed, the process ends.

As described above, in the laser printer 1 according to this embodiment of the present invention, when plural authentication-requiring MICR print data are accumulated in the HDD 15 and the password authentication of the password relevant to the plural authentication-requiring MICR print data in the HDD 15 is completed, the plural authentication-requiring MICR print data relevant to the password are collectively read and printed. Further when the normal MICR print data are received in the middle of the collective printing process of the authentication-requiring MICR print data, the printing process of the normal MICR print data is delayed (waited) until the collective printing process of the authentication-requiring MICR print data is completed. Therefore, after the collective printing process of the authentication-requiring MICR print data is completed, the printing process of the normal MICR print data is started (performed).

As a result, it may become possible to effectively perform the image forming process of the MICR print data and further improve the usability of the laser printer 1.

Sixth Embodiment

Figure 19:
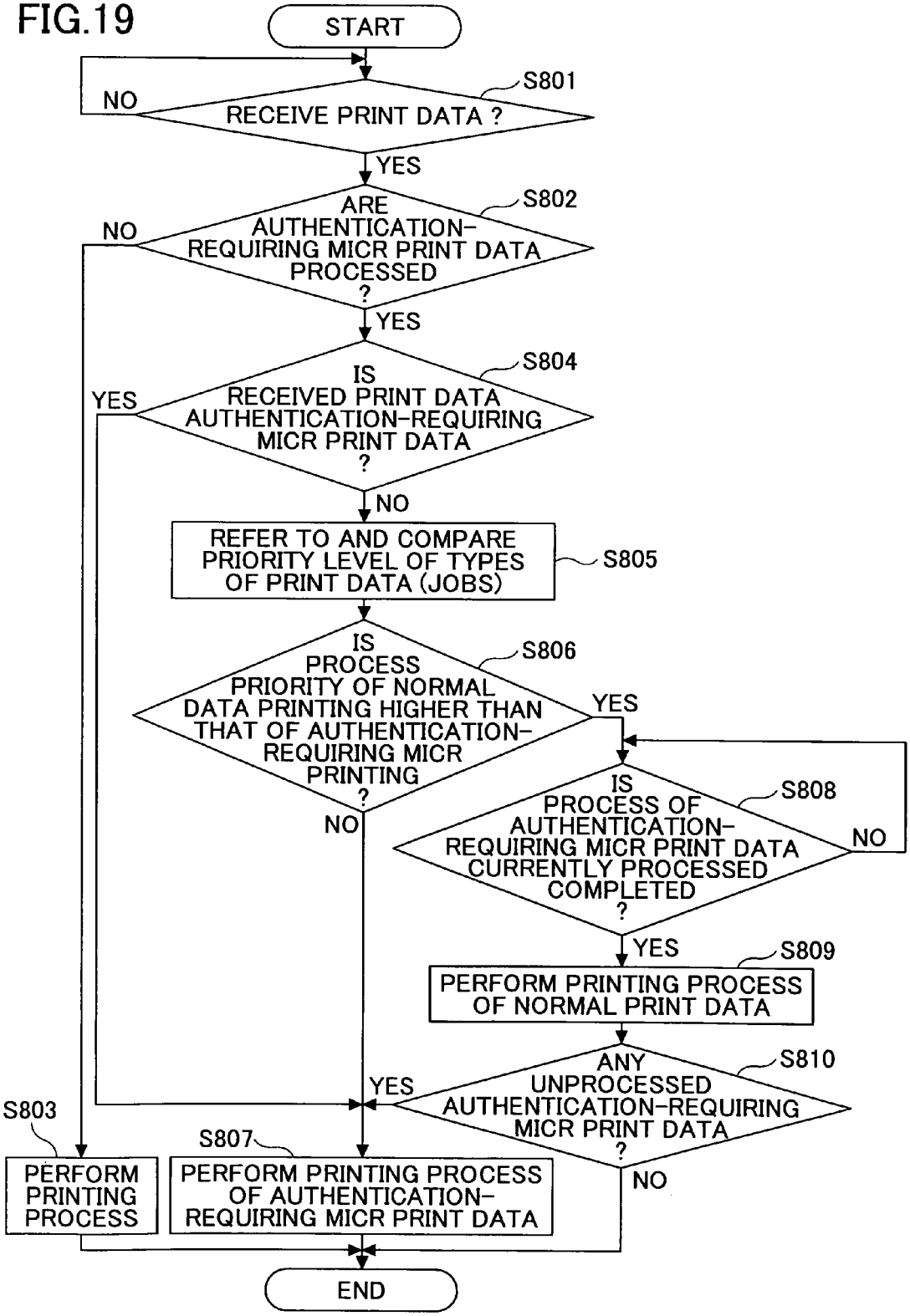
FIG. 19 is a flowchart showing an image forming control process in accordance with processing priority data.

FIG. 19 is flowchart showing an image forming control process that may achieve an image forming apparatus, an image forming control method, an image forming control program and a recording medium according to a sixth embodiment of the present invention.

This sixth embodiment is similarly applied to the laser printer 1 according to the second embodiment of the present invention, and the same reference numerals may be used in the figure for the same or equivalent elements in the second embodiment of the present invention.

According to this embodiment of the present invention, the order of processing the authentication-requiring MICR print data and the normal MICR print data is determined based on the priority set in advance and the image forming control process is sequentially performed based on the determined order.

As shown in the flowchart of FIG. 19, in step S801, it is determined whether print data are received. In step S802, it is determined whether the authentication-requiring MICR print data are being processed. When, in step S802, it is determined that the authentication-requiring MICR print data are not being processed (NO is step S802), the process goes to step S803 to perform a printing process of the received print data and end this process.

When, in step S802, it is determined that the authentication-requiring MICR print data are being processed (YES in step S802), the process goes to step S804. In step S804, the print data drawing section 103 determines whether the received print data are the authentication-requiring MICR print data. When, in step S804, it is determined that the received print data are the authentication-requiring MICR print data, the process goes to step S807. In step S807, the received authentication-requiring MICR print data are printed and the process ends.

On the other hand, when, in step S804, it is determined that the received print data are not the authentication-requiring MICR print data, the process goes to step S805. In step S805, the print data drawing section 103 compares (refers to) the priority of the type of print data (printing jobs). Then, in step S806, the print data drawing section 103 determines whether the priority of processing the normal MICR print data is higher than that of processing the authentication-requiring MICR print data.

For example, the priority of the type of the print data may be provided corresponding to each of the authentication-requiring MICR print data and the normal MICR print data and stored in a format of a priority table and the like in a non-volatile memory such as the NVRAM 18. Further, the priority of the type of the print data may be set by the operations on the operations panel 3, issuing commands from the host system and the like based on, for example, a use record. More specifically, in the priority table, types of print data (printing job) to which priority of the printing order is set are displayed as choices and the values indicating the types of print data (printing jobs) may be stored as the setting values. For example, as the types of print data (printing job), choices "authentication-requiring MICR print data", "normal MICR print data", and "none" are displayed, and from among the three types, the type of the print data (printing job) is selected to which higher priority of printing order is to be set. The choice "none" represents that there is no type of the print data (printing job) to which higher priority of printing order is set, which means that the priority of printing order of the authentication-requiring MICR print data is equal to that of the normal MICR print data. As another example, values representing the priority order may be applied to each of types of print data (printing job). A different value 0.1, or 2 (the greater the value, the higher the priority) may be provided and assigned to each of the type of the print data (printing job).

When, in step S806, it is determined that the priority of processing (printing) order of the normal MICR print data is higher than that of the authentication-requiring MICR print data (YES in step S806), the process goes to step S808.

In step S808, the print data drawing section 103 waits until the processing of the authentication-requiring MICR print data is completed, (i.e., print data drawing section 103 determines whether the processing of the authentication-requiring MICR print data is completed). When it is determined that the processing of the authentication-requiring MICR print data is completed (YES in step S808), the process goes to step S809. In step S809, the printing process of printing the normal MICR print data is performed. After the printing process of printing the normal MICR print data is performed, the process goes to step S810. In step S810, it is determined whether there are any residual authentication-requiring MICR print data that have not been processed. When, in step S810, it is determined that there are residual authentication-requiring MICR print data that have not been processed, the process goes to step S807 where the printing process of printing the residual authentication-requiring MICR print data is performed and the process ends. On the other hand, when, in step S810, it is determined that there are no residual authentication-requiring MICR print data to be processed, the process ends.

As described above, in the laser printer 1 according to this embodiment of the present invention, the priority order of print data is set in advance and stored in the NVRAM 18, and the processing order of the received print data is set based on the priority order stored in the NVRAM 18. Then, the processing order depending on the types of the print data is determined based on the set processing order.

Therefore, it may become possible to determine and perform the processing order based on the user usage conditions or operating plan, and the like, thereby enabling further improving the usability of the laser printer 1.

Further, in the laser printer 1 according to this embodiment of the present invention, the processing priority may be set or changed by operating the operations panel 3 or issuing an instruction from the host system HS, thereby enabling further improving the usability of the laser printer 1.

Seventh Embodiment

Figure 20:
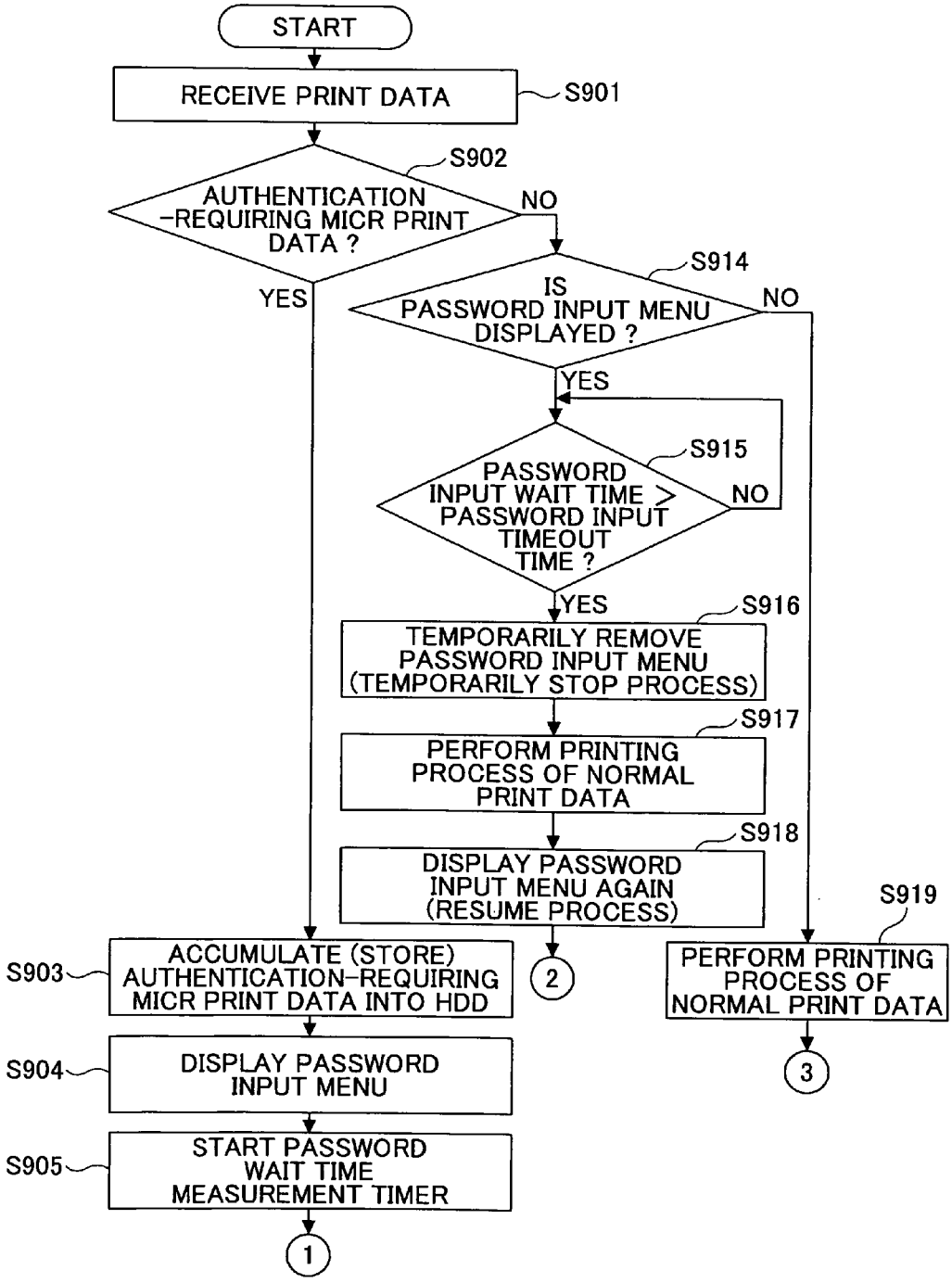
FIG. 20 and 21 collectively show a flowchart showing an image forming control process including a password input wait time control process.
Figure 21:
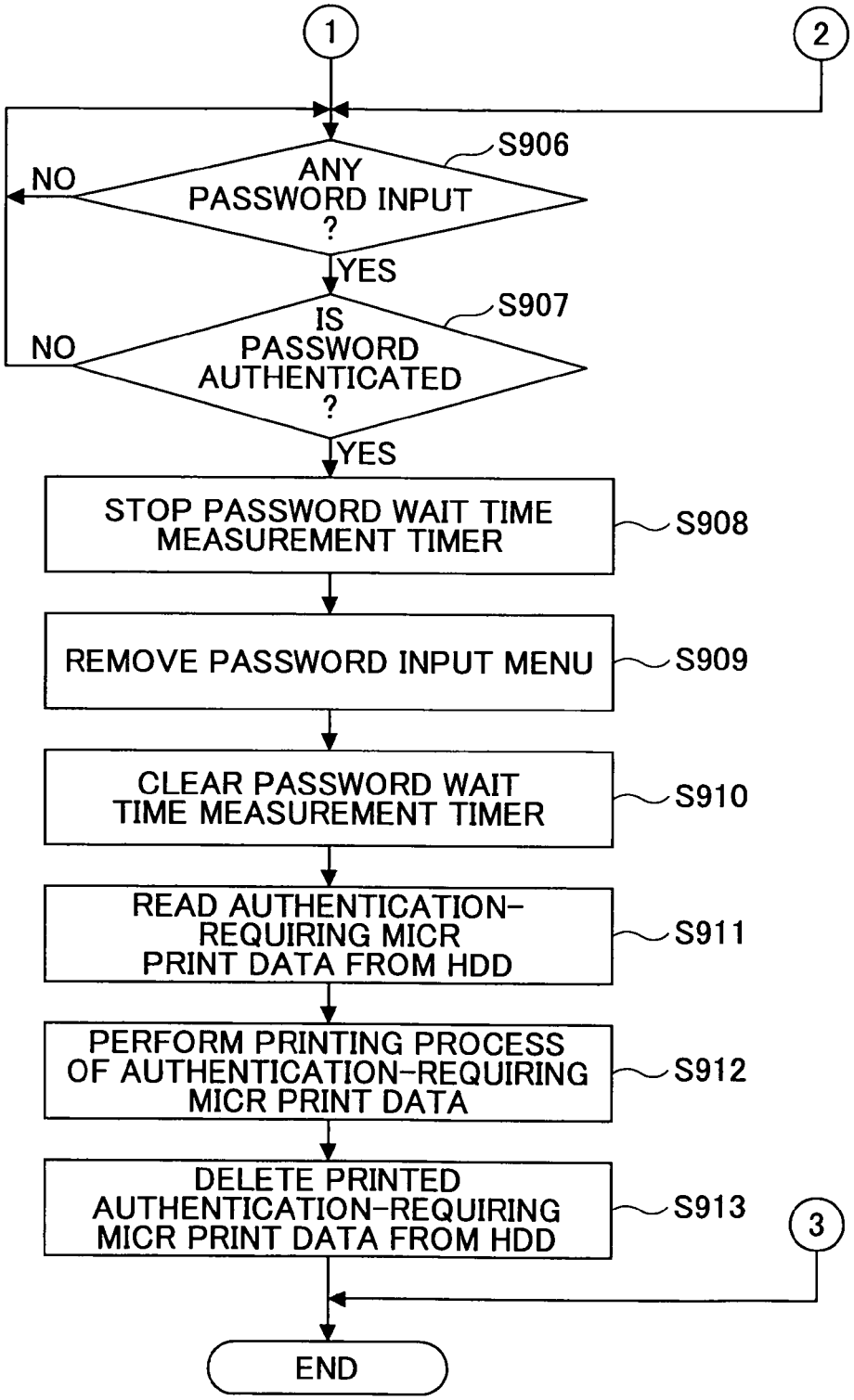

FIGS. 20 and 21 are flowcharts showing an image forming control process that may achieve an image forming apparatus, an image forming control method, an image forming control program and a recording medium according to a seventh embodiment of the present invention. FIG. 20 is a flowchart showing an image forming control process including a password wait time control process for the authentication-requiring MICR print data in a laser printer, the image forming control process being capable of being applied to the image forming apparatus, the image forming control method, the image forming control program and the recording medium according to the seventh embodiment of the present invention.

This seventh embodiment is similarly applied to the laser printer 1 according to the second embodiment of the present invention, and the same reference numerals may be used in the figures for the same or equivalent elements in the second embodiment of the present invention.

In this embodiment of the present invention, the authentication-requiring MICR print data are accumulated into the HDD 15 and when the password is successfully authenticated, the image forming process of printing the authentication-requiring MICR print data is performed. Further, even when the normal MICR print data are received before the password authentication process is successfully completed, the authentication-requiring MICR print data are printed with priority. However, if a predetermined wait time (hereinafter referred to as "password input timeout time") elapses before the password is successfully authenticated, the normal MICR print data are printed with priority.

Namely, as shown in the image forming control process for the authentication-requiring MICR print data of FIG. 20, in step S901, the laser printer 1 receives the print data from the host system HS. In step S902, the print data interpretation section 110 determines whether the print data are the authentication-requiring MICR print data or the normal MICR print data. When, in step S902, it is determined that the print data are the authentication-requiring MICR print data, the process goes to step S903. In step S903, the data accumulation process control section 112 temporarily accumulates the authentication-requiring MICR print data in the HDD 15. In step S904, the print data interpretation section 110 causes the operations panel control section 106 to display the password input menu on the display of the operations panel 3 at a predetermined timing. In step S505, a password input wait time measurement timer is started.

When, in step S906 of FIG. 21, it is determined that the password is input by, for example, the key operations on the operations panel 3, the process goes to step S907. In step S907, the password control section 113 verifies the consistency between the password stored in advance in the NVRAM 18 and the password input via the operations panel 3 and determines whether there is consistency (i.e., whether those passwords are the same). Further, in the same step, when it is determined that there is no consistency (i.e., those passwords are different from each other), for example, an error message stating the input password is not correct is displayed on the display of the operations panel 3, and the process goes back to step S906 to wait for the next password input. On the other hand, in the same step (step S907), when it is determined that there is consistency between the password stored in advance in the NVRAM 18 and the password input via the operations panel 3 (i.e., those passwords are the same), the process goes to step S908. In step S908, the password input wait time measurement timer is stopped. In step S909, the password input menu is removed from the display of the operations panel 3.

Next, in step S910, the value of the password input wait time measurement timer is cleared. In step S911, the print data interpretation section 110 causes the operations panel control section 106 to read the authentication-requiring MICR print data accumulated into the HDD 15 (in this case may be all the authentication-requiring MICR print data that are relevant to the password and that have been already accumulated into the HDD 15) from the HDD 15. In step S912, when necessary, the print data edit process section 115 edits the authentication-requiring MICR print data, and the edited authentication-requiring MICR print data are transmitted to the print data drawing section 103; or when no editing is required, the print data are directly transmitted to the print data drawing section 103. Further, in the same step, the print data drawing section 103 converts the authentication-requiring MICR print data into drawing data, and transmits the converted drawing data to the printer engine 4 via the print control section 104 so that the print control section 104 performs the printing process of (prints) the image of the authentication-requiring MICR print data.

In step S913, after the authentication-requiring MICR print data are printed, the print data interpretation section 110 removes the printed authentication-requiring MICR print data from the HDD 15 via the data accumulation process control section 112 to end the process.

Further, in step S902 of FIG. 20, when it is determined that the print data are not the authentication-requiring MICR print data, the process goes to step S914. In step S914, the print data interpretation section 110 determines whether the password input menu is being displayed, the password input menu corresponding to the authentication-requiring MICR print data that have been received and accumulated in the HDD 15. When it is determined that the password input menu is being displayed, the process goes to step S915. In step S915, the print data interpretation section 110 determines whether the password input wait time measurement timer, which is the time value of the measured password input wait time started when the password input menu is started to be displayed, is greater than the password input timeout time that is set in advance and that is stored in a non-volatile memory such as the NVRAM 18. This password input timeout time may be appropriately changed depending on user usage condition or the like by operating the operations panel 3 or issuing a command from the host system HS. The password input timeout time may be set in units of minutes. As a method of setting the password input timeout time, any method may be used including a method in which one is selected from some choices, for example, 3 min., 5 min, 10 min and the like.

When, in step S915, the correct password is input before the password input wait time elapses, as described above, the print data interpretation section 110 controls so that the authentication-requiring MICR print data whose relevant password has been authenticated are printed with priority (steps S908 through S913). However, when, in step S915, the password input wait time becomes greater than the password input timeout time, the process goes to step S916. In step S916, the print data interpretation section 110 temporarily removes the password input menu. Namely, the process of the authentication-requiring MICR print data is temporarily stopped. In Step S917, the received normal MICR print data (described as normal print data in FIG. 20) are printed with priority.

After the normal MICR print data are printed, the process goes to step S918. In step S918, the print data interpretation section 110 causes the operations panel control section 106 to display again the password input menu that has temporarily removed from the display of the operations panel 3. Then, the process goes to step S906 where it is determined whether the password is input to continue the process described above (steps S906 through S918).

In step S914, when it is determined that the password input menu is not being displayed (NO in step S914), the process goes to step S919. In step S919, when necessary, the print data edit process section 115 edits the received normal MICR print data, and the edited normal MICR print data are transmitted to the print data drawing section 103; or when no editing is required, the print data are directly transmitted to the print data drawing section 103. Further, in the same step, the print data drawing section 103 converts the normal MICR print data into drawing data, and transmits the converted drawing data to the printer engine 4 via the print control section 104 so that the print control section 104 performs the printing process of (prints) the image of the normal MICR print data, and the process ends.

As described above, in the laser printer 1 according to this embodiment of the present invention, the password input menu is displayed on the display of the operations panel 3. Even if the normal MICR print data are received before the password input wait time set in advance elapses, the image forming control process of the normal MICR print data is standing-by (waiting). However, if the password input wait time set in advance elapses without the password being authenticated, the image forming process of the normal MICR print data received during and after the password input wait time is performed with priority.

Therefore, it may become possible to prevent the situation where an image forming process of other normal MICR print data is stopped for a long time because it takes a long time to complete the password authentication process caused by the fact that, for example, it take time before inputting the correct password and incorrect passwords are repeatedly input. As a result, it may become possible to further improve the usability of the laser printer 1.

Further, in the laser printer 1 according to this embodiment of the present invention, the password input wait time may be appropriately set and changed by operating the operations panel 3 or issuing a command from the host system HS. Therefore, it may become possible to set the password input wait time in accordance with user usage conditions and the like, therefore enabling further improving the usability of the laser printer 1.

Further, in each of the above embodiments, the password input menu for allowing performing the printing of the authentication-requiring MICR print data may be displayed on the display of the operations panel 3 at any time including when the accumulation of the authentication-requiring MICR print data into the HDD 15 is completed, when the accumulation of the authentication-requiring MICR print data into the HDD 15 is started, when the receipt of the authentication-requiring MICR print data is started or the like. However, if the password input menu is arranged to be displayed on the display of the operations panel 3 before the accumulation of the authentication-requiring MICR print data into the HDD 15 is completed, the password authentication may be completed before the accumulation of the authentication-requiring MICR print data into the HDD 15. In this case, as shown in FIGS. 17 and 18, the process of accumulating the authentication-requiring MICR print data into the HDD 15 is stopped and the part of the authentication-requiring MICR print data that has been already accumulated in the HDD 15 and the rest of the authentication-requiring MICR print data that have not been accumulated in the HDD 15 may be combined and collectively printed.

According to an aspect of the present invention, the authentication-requiring MICR print data are temporarily stored in an accumulation memory, the authentication-requiring MICR print data being important documents such as checks and bills printed using the MICR technique and requiring the password authentication process. Further, by means of this storage function in the accumulation memory, it may become possible to provide an image forming apparatus such as a printing apparatus and a multi-functional peripheral and the like, an image forming control method, image forming control program and a recording medium capable of performing the MICR printing capable of adjusting among the data stored in the memory and other print data so as to perform effective printing operations.

Although the invention has been described with respect to a specific embodiment for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus comprising:

an image forming unit configured to form an image onto an image forming medium based on received print data by using a cartridge removably provided;

a cartridge determination unit configured to determine whether an MICR cartridge is inserted as the cartridge;

a password storage unit into which a password is registered in advance;

a notification unit configured to send notification to input the password;

a password input unit configured to input the password;

a determination unit configured to compare the password input by the password input unit and the password registered in the password storage unit and determine whether an image forming process of the received print data is allowed to be performed; and a control unit configured to, when the print data are received while the cartridge determination unit determines that the MICR cartridge is inserted as the cartridge, temporarily stop processing the print data, cause the notification unit to send the notification to input the password, and, when the determination unit determines that the image forming process of the received print data is allowed to be performed, perform an MICR image forming control process that causes the image forming unit to resume the processing of the print data.

2. The image forming apparatus according to claim 1, further comprising:

a print data determination unit configured to determine whether the print data are MICR print data based on whether MICR identification data indicating the MICR print data are added-to the received print data; and an MICR identification data removing unit configured to remove the MICR print data from the print data, wherein when the print data determination unit determines that the print data are MICR print data, the control unit performs the MICR image forming control process and causes the MICR identification data removing unit to remove the MICR print data from the print data in the MICR image forming control process.

3. The image forming apparatus according to claim 1, further comprising:

an ON/OFF setting unit configured to turn ON or OFF a function of the MICR image forming control process, wherein only when the function of the MICR image forming control process is turned ON by the ON/OFF setting unit, the control unit performs the MICR image forming control process.

4. The image forming apparatus according to claim 1, further comprising:

a password registration control unit configured to register the password in the password storage unit and delete and change the password registered in the password storage unit in response to a request from a predetermined external apparatus.

5. The image forming apparatus according to claim 1, wherein the password storage unit is a non-volatile storage unit.

6. The image forming apparatus according to claim 1, wherein the notification unit turns ON or blinks a predetermined lamp as well as displays an input menu for the password.

7. An image forming apparatus according to claim 1 and having an image forming unit configured to receive data to be printed at least some of which are MICR print data and form an image of the data to be printed, the image forming apparatus further comprising:

a first determination unit configured to determine whether the received data to be printed are authentication-requiring MICR print data that require performing a password authentication process or normal MICR print data that do not require performing the password authentication process; an accumulation unit configured to accumulate the data to be printed; and a control unit configured to, when the first determination unit determines that the received data to be printed are the authentication-requiring MICR print data, temporarily accumulate the authentication-requiring MICR print data into the accumulation unit, read the authentication-requiring MICR print data from the accumulation unit at a predetermined timing, and cause the image forming unit to form an image of the authentication-requiring MICR print data.

8. The image forming apparatus according to claim 7, further comprising:

a password request unit configured to request input of the password; and a second determination unit configured to determine whether a process of forming an image of the authentication-requiring MICR print data is allowed to be performed by determining whether there is consistency between the password input via the password input unit and a password registered in the password storage unit, wherein the control unit causes the password request unit to request input of the password at the predetermined timing, and, when the second determination unit allows performing the printing process by determining that there is consistency between the password input via the password input unit and the password registered in the password storage unit, reads the authentication-requiring MICR print data from the accumulation unit, and causes the image forming unit to form an image of the authentication-requiring MICR print data.

9. The image forming apparatus according to claim 8, wherein when the normal MICR print data are received while the password request unit requests input of the password, the control unit causes the password request unit to temporarily stop the requested input of the password, and causes the image forming unit to form the image of the normal MICR print data.

10. The image forming apparatus according to claim 9, wherein if the second determination unit does not determine that there is consistency between the password input via the password input unit and the password registered in the password storage unit within a predetermined wait time, the control unit causes the image forming unit to form with priority the image of the normal MICR print data that has been temporarily stopped.

11. The image forming apparatus according to claim 10, further comprising: a wait time setting unit configured to arbitrarily set the predetermined wait time.

12. The image forming apparatus according to claim 8, wherein when the second determination unit allows performing the printing process by determining that there is consistency between the password input via the password input unit and the password registered in the password storage unit, the control unit reads all the authentication-requiring MICR print data that are relevant to the password and causes the image forming unit to collectively form the images of all the authentication-requiring MICR print data.

13. The image forming apparatus according to claim 8, wherein if the second determination unit determines that there is consistency between the password input via the password input unit and the password registered in the password storage unit while the authentication-requiring MICR print data are being accumulated into the accumulation unit, the control unit stops accumulating the authentication-requiring MICR print data into the accumulation unit, combines at least the authentication-requiring MICR print data that have been already accumulated into the accumulation unit and the authentication-requiring MICR print data that have not been accumulated into the accumulation unit, and causes the image forming unit to form an image of the combined authentication-requiring MICR print data.

14. The image forming apparatus according to claim 8, wherein when the normal MICR print data are received while the image forming unit forms an image of the authentication-requiring MICR print data that have been read from the accumulation unit, the control unit causes the image forming unit to stop forming the image of the normal MICR print data and restart forming the image of the normal MICR print data after the forming of the image of the authentication-requiring MICR print data is completed.

15. The image forming apparatus according to claim 8, further comprising:

a priority storage unit configured to store a processing priority of the data to be printed, wherein the control unit sets the processing priority of the received data to be printed based on the processing priority stored in the priority storage unit, and, based on the set processing priority, determines a process to be performed with priority from among the processes including a process of forming the image and a process of accumulating the data to be printed into the accumulation unit.

16. The image forming apparatus according to claim 15, further comprising:

a priority setting unit configured to arbitrarily set the processing priority and register the set processing priority in the priority storage unit.

* * * * *